US007114560B2

(12) United States Patent
Nguyen et al.

(10) Patent No.: US 7,114,560 B2
(45) Date of Patent: Oct. 3, 2006

(54) METHODS FOR ENHANCING TREATMENT FLUID PLACEMENT IN A SUBTERRANEAN FORMATION

(75) Inventors: Philip D. Nguyen, Duncan, OK (US); Ronald G. Dusterhoft, Katy, TX (US)

(73) Assignee: Halliburton Energy Services, Inc., Duncan, OK (US)

( * ) Notice: Subject to any disclaimer, the term of this patent is extended or adjusted under 35 U.S.C. 154(b) by 7 days.

(21) Appl. No.: 10/863,706

(22) Filed: Jun. 8, 2004

(65) Prior Publication Data

US 2004/0256099 A1 Dec. 23, 2004

Related U.S. Application Data

(63) Continuation-in-part of application No. 10/601,407, filed on Jun. 23, 2003, now Pat. No. 7,025,134.

(51) Int. Cl.
*E21B 28/00* (2006.01)
*E21B 33/138* (2006.01)

(52) U.S. Cl. ..... 166/249; 166/90.1; 166/177.6; 166/295

(58) Field of Classification Search ..... 166/90.1, 166/177.6, 249, 295, 300
See application file for complete search history.

(56) References Cited

U.S. PATENT DOCUMENTS

| | | | | |
|---|---|---|---|---|
| 2,238,671 | A | 4/1941 | Woodhouse | |
| 2,294,294 | A * | 8/1942 | Grebe | 166/295 |
| 2,703,316 | A | 3/1955 | Schneider | |
| 2,869,642 | A | 1/1959 | McKay et al. | |
| 3,047,067 | A | 7/1962 | Williams et al. | |
| 3,123,138 | A | 3/1964 | Robichaux | |
| 3,176,768 | A | 4/1965 | Brandt et al. | |
| 3,199,590 | A | 8/1965 | Young | |
| 3,272,650 | A | 9/1966 | MacVittie | |
| 3,297,086 | A | 1/1967 | Spain | |
| 3,308,885 | A | 3/1967 | Sandiford | |
| 3,316,965 | A | 5/1967 | Watanabe | |
| 3,375,872 | A | 4/1968 | McLaughlin et al. | |
| 3,404,735 | A | 10/1968 | Young et al. | |
| 3,415,320 | A | 12/1968 | Young | |
| 3,492,147 | A | 1/1970 | Young et al. | |
| 3,659,651 | A | 5/1972 | Graham | |
| 3,681,287 | A | 8/1972 | Brown et al. | |
| 3,754,598 | A | 8/1973 | Holloway, Jr. | |
| 3,765,804 | A | 10/1973 | Brandon | |

(Continued)

FOREIGN PATENT DOCUMENTS

CA 2063877 5/2003

(Continued)

OTHER PUBLICATIONS

U.S. Appl. No. 10/601,407, filed Jun. 23, 2003.

(Continued)

*Primary Examiner*—George Suchfield
(74) *Attorney, Agent, or Firm*—Robert A. Kent; Baker Botts

(57) ABSTRACT

The present invention relates to methods for controlling the migration of unconsolidated particulates in a portion of a subterranean formation, and more particularly, to the using a pressure pulse to enhance the effectiveness of placement of a consolidation fluid in a portion of a subterranean formation. Some methods of the present invention provide methods of treating a subterranean formation comprising injecting a consolidation fluid into the subterranean formation while periodically applying a pressure pulse having a given amplitude and frequency to the consolidation fluid.

48 Claims, 9 Drawing Sheets

U.S. PATENT DOCUMENTS

| | | | | |
|---|---|---|---|---|
| 3,768,564 | A | 10/1973 | Knox et al. | |
| 3,784,585 | A | 1/1974 | Schmitt et al. | |
| 3,819,525 | A | 6/1974 | Hattenbrun | |
| 3,828,854 | A | 8/1974 | Templeton et al. | |
| 3,842,911 | A | 10/1974 | Know et al. | |
| 3,854,533 | A | 12/1974 | Gurley et al. | |
| 3,857,444 | A | 12/1974 | Copeland | |
| 3,863,709 | A | 2/1975 | Fitch | |
| 3,868,998 | A | 3/1975 | Lybarger et al. | |
| 3,888,311 | A | 6/1975 | Cooke, Jr. | |
| 3,912,692 | A | 10/1975 | Casey et al. | |
| 3,948,672 | A | 4/1976 | Harnsberger | |
| 3,955,993 | A | 5/1976 | Curtice | |
| 3,960,736 | A | 6/1976 | Free et al. | |
| 4,008,763 | A | 2/1977 | Lowe | |
| 4,015,995 | A | 4/1977 | Hess | 106/287 |
| 4,029,148 | A | 6/1977 | Emery | |
| 4,031,958 | A | 6/1977 | Sandiford et al. | 166/270 |
| 4,042,032 | A | 8/1977 | Anderson | 166/276 |
| 4,070,865 | A | 1/1978 | McLaughlin | |
| 4,074,760 | A | 2/1978 | Copeland et al. | |
| 4,085,801 | A | 4/1978 | Sifferman | 166/295 |
| 4,127,173 | A | 11/1978 | Watkins et al. | 166/276 |
| 4,169,798 | A | 10/1979 | DeMartino | |
| 4,245,702 | A | 1/1981 | Haafkens et al. | |
| 4,273,187 | A | 6/1981 | Satter et al. | |
| 4,291,766 | A | 9/1981 | Davies et al. | |
| 4,305,463 | A | 12/1981 | Zakiewicz | |
| 4,336,842 | A | 6/1982 | Graham et al. | |
| 4,352,674 | A | 10/1982 | Fery | |
| 4,353,806 | A | 10/1982 | Canter et al. | |
| 4,387,769 | A | 6/1983 | Erbstoesser et al. | |
| 4,415,805 | A | 11/1983 | Fertl et al. | |
| 4,439,489 | A | 3/1984 | Johnson et al. | |
| 4,443,347 | A | 4/1984 | Underdown et al. | |
| 4,460,052 | A | 7/1984 | Gockel | |
| 4,470,915 | A | 9/1984 | Conway | |
| 4,493,875 | A | 1/1985 | Beck et al. | |
| 4,494,605 | A | 1/1985 | Wiechel et al. | |
| 4,498,995 | A | 2/1985 | Gockel | |
| 4,501,328 | A | 2/1985 | Nichols | |
| 4,526,695 | A | 7/1985 | Erbstosser et al. | |
| 4,527,627 | A | 7/1985 | Graham et al. | |
| 4,541,489 | A | 9/1985 | Wu | |
| 4,546,012 | A | 10/1985 | Brooks | |
| 4,553,596 | A | 11/1985 | Graham et al. | |
| 4,564,459 | A | 1/1986 | Underdown et al. | |
| 4,572,803 | A | 2/1986 | Yamazoe et al. | |
| 4,649,998 | A | 3/1987 | Friedman | |
| 4,664,819 | A | 5/1987 | Glaze et al. | |
| 4,665,988 | A | 5/1987 | Murphey et al. | |
| 4,669,543 | A | 6/1987 | Young | 166/276 |
| 4,675,140 | A | 6/1987 | Sparks et al. | |
| 4,683,954 | A | 8/1987 | Walker et al. | |
| 4,694,905 | A | 9/1987 | Armbruster | |
| 4,715,967 | A | 12/1987 | Bellis | |
| 4,716,964 | A | 1/1988 | Erbstoesser et al. | |
| 4,733,729 | A | 3/1988 | Copeland | |
| 4,739,832 | A | 4/1988 | Jennings, Jr. et al. | |
| 4,785,884 | A | 11/1988 | Armbruster | |
| 4,787,453 | A | 11/1988 | Hewgill et al. | |
| 4,789,105 | A | 12/1988 | Hosokawa et al. | |
| 4,796,701 | A | 1/1989 | Hudson et al. | |
| 4,797,262 | A | 1/1989 | Dewitz | |
| 4,800,960 | A | 1/1989 | Friedman et al. | |
| 4,809,783 | A | 3/1989 | Hollenbeck et al. | |
| 4,817,721 | A | 4/1989 | Pober | |
| 4,829,100 | A | 5/1989 | Murphey et al. | |
| 4,838,352 | A | 6/1989 | Oberste-Padtberg et al. | |
| 4,842,072 | A | 6/1989 | Friedman et al. | |
| 4,846,118 | A | 7/1989 | Lai et al. | |
| 4,848,467 | A | 7/1989 | Cantu et al. | |
| 4,848,470 | A | 7/1989 | Korpics | |
| 4,850,430 | A | 7/1989 | Copeland et al. | |
| 4,886,354 | A | 12/1989 | Welch et al. | |
| 4,888,240 | A | 12/1989 | Graham et al. | |
| 4,895,207 | A | 1/1990 | Friedman et al. | |
| 4,903,770 | A | 2/1990 | Friedman et al. | |
| 4,934,456 | A | 6/1990 | Moradi-Araghi | |
| 4,936,385 | A | 6/1990 | Weaver et al. | |
| 4,942,186 | A | 7/1990 | Murphey et al. | |
| 4,957,165 | A | 9/1990 | Cantu et al. | |
| 4,959,432 | A | 9/1990 | Fan et al. | |
| 4,961,466 | A | 10/1990 | Himes et al. | |
| 4,969,522 | A | 11/1990 | Whitehurst et al. | |
| 4,969,523 | A | 11/1990 | Martin et al. | |
| 4,986,353 | A | 1/1991 | Clark et al. | |
| 4,986,354 | A | 1/1991 | Cantu et al. | |
| 4,986,355 | A | 1/1991 | Casad et al. | |
| 5,030,603 | A | 7/1991 | Rumpf et al. | |
| 5,049,743 | A | 9/1991 | Taylor, III et al. | |
| 5,082,056 | A | 1/1992 | Tackett, Jr. | |
| 5,107,928 | A | 4/1992 | Hilterhaus | |
| 5,128,390 | A | 7/1992 | Murphey et al. | |
| 5,135,051 | A | 8/1992 | Fracteau et al. | |
| 5,142,023 | A | 8/1992 | Gruber et al. | |
| 5,165,438 | A | 11/1992 | Fracteau et al. | |
| 5,173,527 | A | 12/1992 | Calve | |
| 5,178,218 | A | 1/1993 | Dees | |
| 5,182,051 | A | 1/1993 | Bandy et al. | |
| 5,199,491 | A | 4/1993 | Kutts et al. | |
| 5,199,492 | A | 4/1993 | Surles et al. | |
| 5,211,234 | A | 5/1993 | Floyd | |
| 5,216,050 | A | 6/1993 | Sinclair | |
| 5,218,038 | A | 6/1993 | Johnson et al. | |
| 5,232,955 | A | 8/1993 | Caabai et al. | |
| 5,232,961 | A | 8/1993 | Murphey et al. | |
| 5,238,068 | A | 8/1993 | Fredickson | |
| 5,247,059 | A | 9/1993 | Gruber et al. | |
| 5,249,628 | A | 10/1993 | Surjaatmadja | |
| 5,256,729 | A | 10/1993 | Kutts et al. | |
| 5,273,115 | A | 12/1993 | Spafford | |
| 5,285,849 | A | 2/1994 | Surles et al. | 166/295 |
| 5,293,939 | A | 3/1994 | Surles et al. | |
| 5,295,542 | A | 3/1994 | Cole et al. | |
| 5,306,998 | A | 4/1994 | Kimura et al. | |
| 5,320,171 | A | 6/1994 | Laramay | |
| 5,321,062 | A | 6/1994 | Landrum et al. | |
| 5,325,923 | A | 7/1994 | Surjaatmadja et al. | |
| 5,330,005 | A | 7/1994 | Card et al. | |
| 5,332,037 | A | 7/1994 | Schmidt et al. | |
| 5,335,726 | A | 8/1994 | Rodrogues | |
| 5,351,754 | A | 10/1994 | Hardin et al. | |
| 5,358,051 | A | 10/1994 | Rodrigues | |
| 5,359,026 | A | 10/1994 | Gruber | |
| 5,360,068 | A | 11/1994 | Sprunt et al. | |
| 5,361,856 | A | 11/1994 | Surjaatmajda et al. | |
| 5,363,916 | A | 11/1994 | Himes et al. | |
| 5,373,901 | A | 12/1994 | Norman et al. | |
| 5,377,753 | A * | 1/1995 | Haberman et al. | 166/249 |
| 5,377,759 | A | 1/1995 | Surles | 166/295 |
| 5,381,864 | A | 1/1995 | Nguyen et al. | |
| 5,386,874 | A | 2/1995 | Laramay et al. | |
| 5,388,648 | A | 2/1995 | Jordan, Jr. | |
| 5,393,810 | A | 2/1995 | Harris et al. | |
| 5,396,957 | A | 3/1995 | Surjaatmadja et al. | |
| 5,402,846 | A | 4/1995 | Jennings, Jr. et al. | |
| 5,422,183 | A | 6/1995 | Sinclair et al. | |
| 5,423,381 | A | 6/1995 | Surles et al. | |
| 5,439,055 | A | 8/1995 | Card et al. | |
| 5,460,226 | A | 10/1995 | Lawton et al. | |
| 5,464,060 | A | 11/1995 | Hale et al. | |
| 5,475,080 | A | 12/1995 | Gruber et al. | |
| 5,484,881 | A | 1/1996 | Gruber et al. | |

5,494,103 A 2/1996 Surjaatmadja et al.
5,494,178 A 2/1996 Nguyen et al.
5,497,830 A 3/1996 Boles et al.
5,498,280 A 3/1996 Fistner et al.
5,499,678 A 3/1996 Surjaatmadja et al.
5,501,275 A 3/1996 Card et al.
5,505,787 A 4/1996 Yamaguchi
5,512,071 A 4/1996 Yam et al.
5,515,918 A * 5/1996 Brett et al. ..... 166/249
5,520,250 A 5/1996 Harry et al.
5,522,460 A 6/1996 Shu
5,529,123 A 6/1996 Carpenter et al.
5,531,274 A 7/1996 Bienvenu, Jr.
5,536,807 A 7/1996 Gruber et al.
5,545,824 A 8/1996 Stengel et al.
5,547,023 A 8/1996 McDaniel et al.
5,551,513 A 9/1996 Suries et al.
5,551,514 A 9/1996 Nelson et al.
5,582,249 A 12/1996 Caveny et al.
5,582,250 A 12/1996 Constein
5,588,488 A 12/1996 Vijn et al.
5,591,700 A 1/1997 Harris et al.
5,594,095 A 1/1997 Gruber et al.
5,595,245 A 1/1997 Scott, III
5,597,784 A 1/1997 Sinclair et al.
5,604,184 A 2/1997 Ellis et al.
5,604,186 A 2/1997 Hunt et al.
5,609,207 A 3/1997 Dewprashad et al.
5,620,049 A 4/1997 Gipson et al.
5,639,806 A 6/1997 Johnson et al.
5,670,473 A 9/1997 Scepanski
5,692,566 A 12/1997 Surles ..... 166/295
5,697,440 A 12/1997 Weaver et al.
5,698,322 A 12/1997 Tsai et al.
5,712,314 A 1/1998 Surles et al.
5,732,364 A 3/1998 Kalb et al.
5,765,642 A 6/1998 Surjaatmadja
5,775,425 A 7/1998 Weaver et al.
5,782,300 A 7/1998 James et al.
5,783,822 A 7/1998 Buchanan et al.
5,787,986 A 8/1998 Weaver et al.
5,791,415 A 8/1998 Nguyen et al.
5,799,734 A 9/1998 Norman et al.
5,806,593 A 9/1998 Suries
5,830,987 A 11/1998 Smith
5,833,000 A 11/1998 Weaver et al.
5,833,361 A 11/1998 Funk
5,836,391 A 11/1998 Jonasson et al. ..... 166/295
5,836,392 A 11/1998 Urlwin-Smith
5,837,656 A 11/1998 Sinclair et al.
5,837,785 A 11/1998 Kinsho et al.
5,839,510 A 11/1998 Weaver et al. ..... 166/276
5,840,784 A 11/1998 Funkhouser et al. ..... 523/130
5,849,401 A 12/1998 El-Afandi et al.
5,849,590 A 12/1998 Anderson, II et al.
5,853,048 A 12/1998 Weaver et al.
5,864,003 A 1/1999 Qureshi et al.
5,865,936 A 2/1999 Edelman et al.
5,871,049 A 2/1999 Weaver et al. ..... 166/276
5,873,413 A 2/1999 Chatterji et al.
5,875,844 A 3/1999 Chatterji et al.
5,875,845 A 3/1999 Chatterji et al.
5,875,846 A 3/1999 Chatterji et al.
5,893,383 A 4/1999 Fracteau
5,893,416 A 4/1999 Read
5,908,073 A 6/1999 Nguyen et al.
5,911,282 A 6/1999 Onan et al.
5,916,933 A 6/1999 Johnson et al.
5,921,317 A 7/1999 Dewprashad et al.
5,924,488 A 7/1999 Nguyen et al.
5,929,437 A 7/1999 Elliott et al.
5,944,105 A 8/1999 Nguyen
5,945,387 A 8/1999 Chatterji et al.
5,948,734 A 9/1999 Sinclair et al.
5,957,204 A 9/1999 Chatterji et al.
5,960,877 A 10/1999 Funkhouser et al. ..... 166/270
5,960,880 A 10/1999 Nguyen et al.
5,964,291 A 10/1999 Bourne et al.
5,969,006 A 10/1999 Onan et al.
5,969,523 A 10/1999 Martin et al.
5,977,283 A 11/1999 Rossitto
5,994,785 A 11/1999 Higuchi et al.
RE36,466 E 12/1999 Nelson et al.
6,003,600 A 12/1999 Nguyen et al.
6,004,400 A 12/1999 Bishop et al.
6,006,835 A 12/1999 Onan et al.
6,006,836 A 12/1999 Chatterji et al.
6,012,524 A 1/2000 Chatterji et al.
6,016,870 A 1/2000 Dewprashad et al. ..... 166/295
6,024,170 A 2/2000 McCabe et al.
6,028,113 A 2/2000 Scepanski
6,028,534 A 2/2000 Ciglenec et al.
6,040,398 A 3/2000 Kinsho et al.
6,047,772 A 4/2000 Weaver et al.
6,059,034 A 5/2000 Rickards et al.
6,059,035 A 5/2000 Chatterji et al.
6,059,036 A 5/2000 Chatterji et al.
6,068,055 A 5/2000 Chatterji et al.
6,069,117 A 5/2000 Onan et al.
6,074,739 A 6/2000 Katagiri
6,079,492 A 6/2000 Hoogteijling et al.
6,098,711 A 8/2000 Chatterji et al.
6,114,410 A 9/2000 Betzold
6,123,871 A 9/2000 Carroll
6,123,965 A 9/2000 Jacon et al.
6,124,246 A 9/2000 Heathman et al.
6,130,286 A 10/2000 Thomas et al.
6,135,987 A 10/2000 Tsai et al.
6,140,446 A 10/2000 Fujiki et al.
6,148,911 A 11/2000 Gipson et al.
6,152,234 A 11/2000 Newhouse et al.
6,162,766 A 12/2000 Muir et al.
6,169,058 B1 1/2001 Le et al.
6,172,011 B1 1/2001 Card et al.
6,172,077 B1 1/2001 Curtis et al.
6,176,315 B1 1/2001 Reddy et al.
6,177,484 B1 1/2001 Surles ..... 523/131
6,184,311 B1 2/2001 O'Keefe et al.
6,187,834 B1 2/2001 Thayer et al.
6,187,839 B1 2/2001 Eoff et al. ..... 523/130
6,189,615 B1 2/2001 Sydansk
6,192,985 B1 2/2001 Hinkel et al.
6,192,986 B1 2/2001 Urlwin-Smith
6,196,317 B1 3/2001 Hardy
6,202,751 B1 3/2001 Chatterji et al.
6,209,643 B1 4/2001 Nguyen et al.
6,209,644 B1 4/2001 Brunet
6,209,646 B1 4/2001 Reddy et al.
6,210,471 B1 4/2001 Craig
6,214,773 B1 4/2001 Harris et al.
6,231,644 B1 5/2001 Chatterji et al.
6,234,251 B1 5/2001 Chatterji et al.
6,238,597 B1 5/2001 Yim et al.
6,241,019 B1 6/2001 Davidson et al.
6,242,390 B1 6/2001 Mitchell et al.
6,244,344 B1 6/2001 Chatterji et al.
6,257,335 B1 7/2001 Nguyen et al.
6,260,622 B1 7/2001 Blok et al.
6,271,181 B1 8/2001 Chatterji et al.
6,274,650 B1 8/2001 Cui
6,279,652 B1 8/2001 Chatterji et al.
6,279,656 B1 8/2001 Sinclair et al.
6,283,214 B1 9/2001 Guinot et al.
6,302,207 B1 10/2001 Nguyen et al. ..... 166/276
6,311,773 B1 11/2001 Todd et al.
6,321,841 B1 11/2001 Eoff et al.

6,323,307 B1 11/2001 Bigg et al.
6,326,458 B1 12/2001 Gruber et al.
6,328,105 B1 12/2001 Betzold
6,328,106 B1 12/2001 Griffith et al.
6,330,916 B1 12/2001 Rickards et al.
6,330,917 B1 12/2001 Chatterji et al.
6,350,309 B1 2/2002 Chatterji et al.
6,357,527 B1 3/2002 Norman et al.
6,364,018 B1 4/2002 Brannon et al.
6,364,945 B1 4/2002 Chatterji et al.
6,367,165 B1 4/2002 Huttlin
6,367,549 B1 4/2002 Chatterji et al.
6,372,678 B1 4/2002 Youngsman et al.
6,376,571 B1 4/2002 Chawla et al.
6,387,986 B1 5/2002 Moradi-Araghi et al.
6,390,195 B1 5/2002 Nguyen et al.
6,401,817 B1 6/2002 Griffith et al.
6,405,797 B1 6/2002 Davidson et al.
6,406,789 B1 6/2002 McDaniel et al.
6,408,943 B1 6/2002 Schultz et al.
6,422,314 B1 7/2002 Todd et al.
6,439,309 B1 8/2002 Matherly et al. ..... 166/276
6,439,310 B1 8/2002 Scott, III et al.
6,440,255 B1 8/2002 Kohlhammer et al.
6,446,727 B1 9/2002 Zemlak et al.
6,448,206 B1 9/2002 Griffith et al.
6,450,260 B1 9/2002 James et al.
6,454,003 B1 9/2002 Chang et al.
6,458,885 B1 10/2002 Stengal et al.
6,485,947 B1 11/2002 Rajgarhia et al.
6,488,091 B1 12/2002 Weaver et al.
6,488,763 B1 12/2002 Brothers et al.
6,494,263 B1 12/2002 Todd
6,503,870 B1 1/2003 Griffith et al.
6,508,305 B1 1/2003 Brannon et al.
6,527,051 B1 3/2003 Reddy et al.
6,528,157 B1 3/2003 Hussain et al.
6,531,427 B1 3/2003 Shuchart et al.
6,538,576 B1 3/2003 Schultz et al.
6,543,545 B1 4/2003 Chatterji et al.
6,552,333 B1 4/2003 Storm et al.
6,554,071 B1 4/2003 Reddy et al.
6,555,507 B1 4/2003 Chatterji et al.
6,569,814 B1 5/2003 Brady et al.
6,582,819 B1 6/2003 McDaniel et al.
6,593,402 B1 7/2003 Chatterji et al.
6,599,863 B1 7/2003 Palmer et al.
6,608,162 B1 8/2003 Chiu et al.
6,616,320 B1 9/2003 Huber et al.
6,620,857 B1 9/2003 Valet
6,626,241 B1 9/2003 Nguyen
6,632,527 B1 10/2003 McDaniel et al.
6,632,892 B1 10/2003 Rubinsztajn et al.
6,642,309 B1 11/2003 Komitsu et al.
6,648,501 B1 11/2003 Huber et al.
6,659,179 B1 12/2003 Nguyen
6,664,343 B1 12/2003 Narisawa et al.
6,667,279 B1 12/2003 Hessert et al.
6,668,926 B1 12/2003 Nguyen et al.
6,669,771 B1 12/2003 Tokiwa et al.
6,681,856 B1 1/2004 Chatterji et al.
6,686,328 B1 2/2004 Binder
6,691,778 B1 * 2/2004 Cole et al. ..... 166/249
6,705,400 B1 3/2004 Nguyen et al.
6,710,019 B1 3/2004 Sawdon et al.
6,713,170 B1 3/2004 Kaneka et al.
6,725,926 B1 4/2004 Nguyen et al.
6,725,931 B1 4/2004 Nguyen et al.
6,729,404 B1 5/2004 Nguyen et al.
6,732,800 B1 5/2004 Acock et al.
6,745,159 B1 6/2004 Todd et al.
6,749,025 B1 6/2004 Brannon et al.
6,763,888 B1 7/2004 Harris et al.
6,766,858 B1 7/2004 Nguyen et al.
6,776,236 B1 8/2004 Nguyen
6,832,650 B1 12/2004 Nguyen et al.
6,851,474 B1 2/2005 Nguyen
6,887,834 B1 5/2005 Nguyen et al.
6,978,836 B1 12/2005 Nguyen et al. ..... 166/295
2001/0016562 A1 8/2001 Muir et al.
2001/0017206 A1 * 8/2001 Davidson et al. ..... 166/249
2002/0043370 A1 4/2002 Poe
2002/0048676 A1 4/2002 McDaniel et al.
2002/0070020 A1 6/2002 Nguyen
2003/0006036 A1 1/2003 Malone et al.
2003/0060374 A1 3/2003 Cooke, Jr.
2003/0114314 A1 6/2003 Ballard et al.
2003/0130133 A1 7/2003 Vollmer
2003/0131999 A1 7/2003 Nguyen et al.
2003/0148893 A1 8/2003 Lungofer et al.
2003/0186820 A1 10/2003 Thesing
2003/0188766 A1 10/2003 Banerjee et al.
2003/0188872 A1 10/2003 Nguyen et al.
2003/0196805 A1 10/2003 Boney et al.
2003/0205376 A1 11/2003 Ayoub et al.
2003/0230408 A1 12/2003 Acock et al.
2003/0234103 A1 12/2003 Lee et al.
2004/0000402 A1 1/2004 Nguyen et al.
2004/0014607 A1 1/2004 Sinclair et al.
2004/0014608 A1 1/2004 Nguyen et al.
2004/0040706 A1 3/2004 Hossaini et al.
2004/0040708 A1 3/2004 Stephenson et al.
2004/0040713 A1 3/2004 Nguyen et al.
2004/0048752 A1 3/2004 Nguyen et al.
2004/0055747 A1 3/2004 Lee
2004/0106525 A1 6/2004 Willbert et al.
2004/0138068 A1 7/2004 Rimmer et al.
2004/0149441 A1 8/2004 Nguyen et al.
2004/0152601 A1 8/2004 Still et al.
2004/0177961 A1 9/2004 Nguyen et al.
2004/0194961 A1 10/2004 Nguyen et al.
2004/0206499 A1 10/2004 Nguyen et al.
2004/0211559 A1 10/2004 Nguyen et al.
2004/0211561 A1 10/2004 Nguyen et al.
2004/0221992 A1 11/2004 Nguyen et al.
2004/0231845 A1 11/2004 Cooke, Jr.
2004/0231847 A1 11/2004 Nguyen et al.
2004/0256099 A1 12/2004 Nguyen et al.
2004/0261995 A1 12/2004 Nguyen et al.
2004/0261997 A1 12/2004 Nguyen et al.
2005/0000731 A1 1/2005 Nguyen et al.
2005/0006093 A1 1/2005 Nguyen et al.
2005/0006095 A1 1/2005 Justus et al. ..... 166/295
2005/0006096 A1 1/2005 Nguyen et al.
2005/0034862 A1 2/2005 Nguyen et al. ..... 166/281
2005/0045326 A1 3/2005 Nguyen

FOREIGN PATENT DOCUMENTS

EP 0313243 B1 10/1988
EP 0528595 A1 8/1992
EP 0510762 A2 11/1992
EP 0643196 A2 6/1994
EP 0834644 A2 4/1998
EP 0853186 A2 7/1998
EP 0864726 A2 9/1998
EP 0879935 B1 11/1998
EP 0933498 A1 8/1999
EP 1001133 A1 5/2000
EP 1132569 A2 9/2001
EP 1326003 A1 7/2003
EP 1362978 A1 11/2003
EP 139455 A1 3/2004
EP 1396606 A2 3/2004
EP 1398640 A1 3/2004
EP 1403466 A2 3/2004

| | | | |
|---|---|---|---|
| EP | 1464789 | A1 | 10/2004 |
| GB | 1107584 | | 3/1968 |
| GB | 1264180 | | 12/1969 |
| GB | 1292718 | | 10/1972 |
| GB | 2382143 | A | 4/2001 |
| WO | WO 93/15127 | | 8/1993 |
| WO | WO 94/07949 | | 4/1994 |
| WO | WO 94/08078 | | 4/1994 |
| WO | WO 94/08090 | | 4/1994 |
| WO | WO 95/09879 | | 4/1995 |
| WO | WO 97/11845 | | 4/1997 |
| WO | WO 99/27229 | | 6/1999 |
| WO | WO 01/81914 | | 11/2001 |
| WO | WO 01/87797 | A1 | 11/2001 |
| WO | WO 02/12674 | A1 | 2/2002 |
| WO | WO 03/027431 | A1 | 4/2003 |
| WO | WO 04/037946 | A1 | 5/2004 |
| WO | WO 04/038176 | A1 | 5/2004 |
| WO | WO 05/021928 | A2 | 3/2005 |

OTHER PUBLICATIONS

W. Owens, et al., Waterflood Pressure Pulsing for Fractured Reservoirs, SPE 1123, 1966.
M Felsenthal et al., Pressure Pulsing—An Improved Method of Waterflooding Fractured Reservoirs, SPE 1788, 1957.
S.H. Raza, Water and Gas Cyclic Pulsing Method for Improved Oil Recovery, SPE 3005, 1971.
C.P. Peng, et al., Pressure Pulsing Waterflooding in Dual Porosity Naturally Fractured Reservoirs, SPE 17587, 1988.
M. Dusseault et al., Pressure Pulse Workovers in Heavy Oil, SPE 79033, 2002.
David W. Yang, et al., Experimental Study on Fracture Initiation by Pressure Pulses, SPE 63035, 2000.
Foreign communication from a related counterpart application, Sep. 16, 2004.
S. W. Almond, et al., "*Factors Affecting Proppant Flowback with Resin Coated Proppants,*" Society of Petroleum Engineers, Inc., SPE 30096, p. 171-186, 1995.
U.S. Appl. No. 10/383,154, filed Mar. 6, 2003, Nguyen et al.
U.S. Appl. No. 10/394,898, filed Mar. 21, 2003, Eoff et al.
U.S. Appl. No. 10/408,800, filed Apr. 7, 2003, Nguyen et al.
U.S. Appl. No. 10/603,492, filed Jun. 25, 2003, Nguyen et al.
U.S. Appl. No. 10/649,029, filed Aug. 27, 2003, Nguyen et al.
U.S. Appl. No. 10/650,063, filed Aug. 26, 2003, Nguyen.
U.S. Appl. No. 10/650,064, filed Aug. 26, 2003, Nguyen et al.
U.S. Appl. No. 10/650,065, filed Aug. 26, 2003, Nguyen.
U.S. Appl. No. 10/659,574, filed Sep. 10, 2003, Nguyen et al.
U.S. Appl. No. 10/727,365, filed Dec. 4, 2003, Reddy et al.
U.S. Appl. No. 10/751,593, filed Jan. 5, 2004, Nguyen.
U.S. Appl. No. 10/775,347, filed Feb. 10, 2004, Nguyen.
U.S. Appl. No. 10/791,944, filed Mar. 3, 2004, Nguyen.
U.S. Appl. No. 10/793,711, filed Mar. 5, 2004, Nguyen et al.
U.S. Appl. No. 10/852,811, filed May 25, 2004, Nguyen.
U.S. Appl. No. 10/853,879, filed May 26, 2004, Nguyen et al.
U.S. Appl. No. 10/860,951, filed Jun. 4, 2004, Stegent et al.
U.S. Appl. No. 10/861,829, filed Jun. 4, 2004, Stegent et al.
U.S. Appl. No. 10/862,986, filed Jun. 8, 2004, Nguyen et al.
U.S. Appl. No. 10/864,061, filed Jun. 9, 2004, Blauch et al.
U.S. Appl. No. 10/864,618, filed Jun. 9, 2004, Blauch et al.
U.S. Appl. No. 10/868,593, filed Jun. 15, 2004, Nguyen et al.
U.S. Appl. No. 10/868,608, filed Jun. 15, 2004, Nguyen et al.
U.S. Appl. No. 10/937,076, filed Sep. 9, 2004, Nguyen et al.
U.S. Appl. No. 10/944,973, filed Sep. 20, 2004, Nguyen et al.
U.S. Appl. No. 10/972,648, filed Oct. 25, 2004, Dusterhoft et al.
U.S. Appl. No. 10/977,673, Oct. 29, 2004, Nguyen.
U.S. Appl. No. 11/009,277, filed Dec. 8, 2004, Welton et al.
U.S. Appl. No. 11/011,394, filed Dec. 12, 2004, Nguyen et al.
U.S. Appl. No. 11/035,833, filed Jan. 14, 2005, Nguyen.
U.S. Appl. No. 11/049,252, filed Feb. 2, 2005, Van Batenburg et al.
U.S. Appl. No. 11/053,280, filed Feb. 8, 2005, Nguyen.
U.S. Appl. No. 11/056,635, filed Feb. 11, 2005, Dusterhoft et al.
Halliburton, *CoalStim$^{SM}$ Service, Helps Boost Cash Flow From CBM Assets,* Stimulation, HO3679 10/03, 2003, Halliburton Communications.
Halliburton, *Conductivity Endurance Technology For High Permeability Reservoirs, Helps Prevent Intrusion of Formation Material Into the Proppant Pack for Improved Long-term Production,* Stimulation, 2003, Halliburton Communications.
Halliburton, *Expedite® Service, A Step-Change Improvement Over Conventional Proppant Flowback Control Systems. Provides Up to Three Times the Conductivity of RCPs.,* Stimulation, HO3296 05/04, Halliburton Communications, 2004.
Halliburton Technical Flier—Multi Stage Frac Completion Methods, 2 pages, undated.
Halliburton "*CobraFrac$^{SM}$ Service, Coiled Tubing Fracturing—Cost-Effective Method for Stimulating Untapped Reserves",* 2 pages, 2004.
Halliburton "*CobraJetFrac$^{SM}$ Service, Cost-Effective Technology That Can Help Reduce Cost per BOE Produced, Shorten Cycle time and Reduce Capex*", undated.
Halliburton Cobra Frac Advertisement, 2001.
Halliburton "*SurgiFrac$^{SM}$ Service, a Quick and cost-Effective Method to Help Boost Production From Openhole Horizonal Completions*", 2002.
Halliburton, *SandWedge® NT Conductivity Enhancement System, Enhances Proppant Pack Conductivity and Helps Prevent Intrusion of Formation Material for Improved Long-Term Production,* Stimulation, HO2289 05/04, Halliburton Communications.
Nguyen et al., *A Novel Approach For Enhancing Proppant Consolidation: Laboratory Testing And Field Applications,* SPE Paper No. 77748, 2002.
SPE 15547, *Field Application of Lignosulfonate Gels To Reduce Channeling,* South Swan Hills Miscible Unit, Alberta, Canada, by O.R. Wagner et al., 1986.
Owens et al., *Waterflood Pressure Pulsing for Fractured Reservoirs* SPE 1123, 1966.
Nguyen et al., *New Guidelines For Applying Curable Resin-Coated Proppants,* SPE Paper No. 39582, 1997.
Kazakov et al., "*Optimizing and Managing Coiled Tubing Frac Strings"* SPE 60747, 2000.
Advances in Polymer Science, vol. 157, "*Degradable Aliphatic Polyesters"* edited by A.-C. Alberston, 2001.
Gorman, *Plastic Electric: Lining up the Future of Conducting Polymers* Science News, vol. 163, May 17, 2003.
Gidley et al., "*Recent Advances in Hydraulic Fracturing,"* Chapter 6, pp. 109-130, 1989.
Simmons et al., "*Poly(phenyllactide): Synthesis, Characterization, and Hydrolytic Degradation, Biomacromolecules",* vol. 2, No. 2, pp. 658-663, 2001.
Yin et al., "*Preparation and Characterization of Substituted Polylactides",* Americal Chemical Society, vol. 32, No. 23, pp. 7711-7718, 1999.
Yin et al., "*Synthesis and Properties of Polymers Derived from Substituted Lactic Acids",* American Chemical Society, Ch. 12, pp. 147-159, 2001.
Cantu et al., "*Laboratory and Field Evaluation of a Combined Fluid-Loss Control Additive and Gel Breaker for Fracturing Fluids,"* SPE 18211, 1990.
Love et al., "*Selectively Placing Many Fractures in Openhole Horizontal Wells Improves Production",* SPE 50422, 1998.
McDaniel et al. "*Evolving New Stimulation Process Proves Highly Effective In Level 1 Dual-Lateral Completion"* SPE 78697, 2002.
Albertsson et al., "*Aliphatic Polyesters: Synthesis, Properties and Applications",* Advances in Polymer Science, vol. 57 Degradable Aliphatic Polyesters, 2002.
Dechy-Cabaret et al., "*Controlled Ring-Operated Polymerization of Lactide and Glycolide"* American Chemical Society, Chemical Reviews, A-Z, AA-AD, 2004.
Funkhouser et al., "*Synthetic Polymer Fracturing Fluid For High-Temperature Applications",* SPE 80236, 2003.
*Chelating Agents,* Encyclopedia of Chemical Technology, vol. 5 (764-795), undated.

Vichaibun et al., "*A New Assay for the Enzymatic Degradation of Polylactic Acid, Short Report*", ScienceAsia, vol. 29, pp. 297-300, 2003.
CDX Gas, CDX Solution, 2003, CDX, LLC, Available @ www.cdxgas.com/solution.html, printed pp. 1-2, undated.
CDX Gas, "*What is Coalbed Methane?*" CDX, LLC. Available @ www.cdxgas.com/what.html, printed p. 1, undated.
Halliburton brochure entitled "H2Zero™ Service Introducing The Next Generation of cost-Effective Conformance Control Solutions", 2002.
Halliburton brochure entitled INJECTROL® A Component, 1999.
Halliburton brochure entitled "INJECTROL® G Sealant", 1999.
Halliburton brochure entitled "INJECTROL® IT Sealant", 1999.
Halliburton brochure entitled "INJECTROL® Service Treatment", 1999.
Halliburton brochure entitled "INJECTROL® U Sealant", 1999.
Halliburton brochure entitled "Sanfix® A Resin", 1999.
Halliburton brochure entitled "Pillar Frac Stimulation Technique" Fracturing Services Technical Data Sheet, 2 pages, undated.
Foreign search report and opinion (CPW 21582 EP), Mar. 11, 2005.

* cited by examiner

METHODS FOR ENHANCING TREATMENT FLUID PLACEMENT IN A SUBTERRANEAN FORMATION

CROSS-REFERENCE TO RELATED APPLICATIONS

This application is a continuation-in-part of U.S. application Ser. No. 10/601,407 filed on Jun. 23, 2003 now U.S. Pat. No. 7,025,134.

BACKGROUND

The present invention relates to methods for controlling the migration of unconsolidated particulates in a portion of a subterranean formation, and more particularly, to the using a pressure pulse to enhance the effectiveness of placement of a consolidation fluid in a portion of a subterranean formation.

Hydrocarbon wells are often located in unconsolidated portions of a subterranean formation, that is, portions of a subterranean formation that contain particulate matter capable of migrating with produced fluids out of the formation and into a well bore. The presence of particulate matter, such as sand, in produced fluids may be disadvantageous and undesirable in that such particulates may abrade pumping equipment and other producing equipment and may reduce the fluid production capabilities of the producing portions of the subterranean formation. Unconsolidated portions of subterranean formations include those which contain loose particulates that are readily entrained by produced fluids and those wherein the particulates are bonded together with insufficient bond strength to withstand the forces produced by the production of fluids through the zones.

One conventional method used to control formation particulates in unconsolidated formations involves consolidating a portion of a subterranean formation into a hard, permeable mass by applying a curable resin composition to the portion of the subterranean formation. In one example of such a technique, an operator pre-flushes the formation, applies a resin composition, and then applies an after-flush fluid to remove excess resin from the pore spaces of the zones. Such resin consolidation methods are widely used but may be limited by the ability to place the resin through enough of the unconsolidated portion of the formation to adequately control the particulates. Even when the resin compositions are designed with very low viscosities, they are often unable to achieve significant penetration or uniform penetration into the portion of the subterranean formation. Conditions such as variable formation permeability; formation damage in the near-well bore area; debris along the well bore, a perforation tunnel, or a fracture face; and, compaction zones along the well bore, a perforation tunnel, or a fracture face may make uniform placement of resin compositions extremely difficult to achieve. The problems are particularly severe when used to treat long intervals of unconsolidated regions.

In production operations, hydrocarbons may be profitably extracted from the reservoir by a variety of recovery techniques. One such technique is pressure pulse waterflooding. Generally, the combination of a secondary recovery technique, e.g., waterflooding, with the use of pressure pulsing is thought to enable the recovery of up to about 30% to about 45% of the reserves. Pressure pulsing as referred to herein will be understood to mean deliberately varying the fluid pressure in the subterranean reservoir through the application of periodic increases, or "pulses," in the pressure of a fluid being injected into the reservoir. Pressure pulsing has also been performed through the use of a pulse-generating apparatus attached to a well head located above the surface. Pulsing typically occurs either by raising and lowering a string of tubing located within the well bore, or by employing a flutter valve assembly which periodically opens and closes to permit a fluid to be pumped into the well bore.

While such pressure pulsing techniques have been used to enhance water injection for secondary oil recovery, they have not been used to insert resins or formation consolidation type fluids into a formation. The present invention seeks to use the increase flow benefits of pressure pulsing to increase the ability of a resin composition to penetrate a portion of a subterranean formation.

SUMMARY OF THE INVENTION

The present invention relates to methods for controlling the migration of unconsolidated particulates in a portion of a subterranean formation, and more particularly, to the using a pressure pulse to enhance the effectiveness of placement of a consolidation fluid in a portion of a subterranean formation.

Some methods of the present invention provide methods of treating a subterranean formation comprising injecting a consolidation fluid into the subterranean formation while periodically applying a pressure pulse having a given amplitude and frequency to the consolidation fluid.

Other methods of the present invention provide methods of controlling the migration of unconsolidated particulates in a portion of a subterranean formation comprising injecting a consolidation fluid into the subterranean formation while periodically applying a pressure pulse having a given amplitude and frequency to the consolidation fluid; and allowing the consolidation fluid to control the migration of unconsolidated particulates.

Other methods of the present invention provide methods of using a pressure pulse to enhance the effectiveness of placement of a consolidation fluid in a portion of a subterranean formation, comprising injecting a consolidation fluid into the subterranean formation while periodically applying a pressure pulse having a given amplitude and frequency to the consolidation fluid so as to effectively place the consolidation fluid in the portion of the subterranean formation.

The objects, features, and advantages of the present invention will be readily apparent to those skilled in the art upon a reading of the description of the preferred embodiments, which follows.

DESCRIPTION OF PREFERRED EMBODIMENTS

The present invention relates to methods for controlling the migration of unconsolidated particulates in a portion of a subterranean formation, and more particularly, to the using a pressure pulse to enhance the effectiveness of placement of a consolidation fluid in a portion of a subterranean formation. According to the method of the present invention, a pressure pulse generated by a suitable apparatus is propagated through a well bore and into a portion of a subterranean formation in order to enhance the penetration of a consolidation fluid into the portion of the subterranean formation.

Hydrocarbon production may be stimulated through the use of pressure pulses. In such circumstances, a fluid, often water, is introduced to a subterranean formation under pressure to create or enhance fractures within the formation and then the pressure is released allowing the water and any hydrocarbons released from the fractures to flow into the well bore and be produced. The present invention has discovered that such pressure pulse/vibration energy methods have utility outside the field of hydrocarbon stimulation and that such methods may, in fact, be useful in fluid placement applications.

The present invention provides methods for placing consolidation fluids in a subterranean formation using pressure pulses or vibration energy. Some embodiments of the present invention provide methods for treating subterranean a formation comprising the steps of, placing a consolidation fluid into a well bore and in contact with a portion of a subterranean formation to be consolidated and then sending energy in the form of vibration or pressure pulses through the fluid and formation. Such energy changes affect the dilatancy of the pores within the formation and act, inter alia, to provide additional energy to help overcome the effects of surface tension and capillary pressure within the formation. By overcoming such effects, the fluid may be able to penetrate more deeply and uniformly into the formation. Moreover, the methods of the present invention may be used to increase the coverage of a treatment fluid into zones with different permeabilities, without the requiring the use of an additive diverter.

I. Effect of Pressure Pulse/Vibration Energy on a Formation

Continuous dilation may act according to the methods of the present invention to enhance the penetration of the treatment fluid into the formation. In the methods of the present invention, the pressure applied should be great enough to effect some degree of pore dilation within the subterranean formation but less than the fracture pressure of the formation. It is within the ability of one skilled in the art to determine a proper pressure to apply to a formation.

Figure 6:
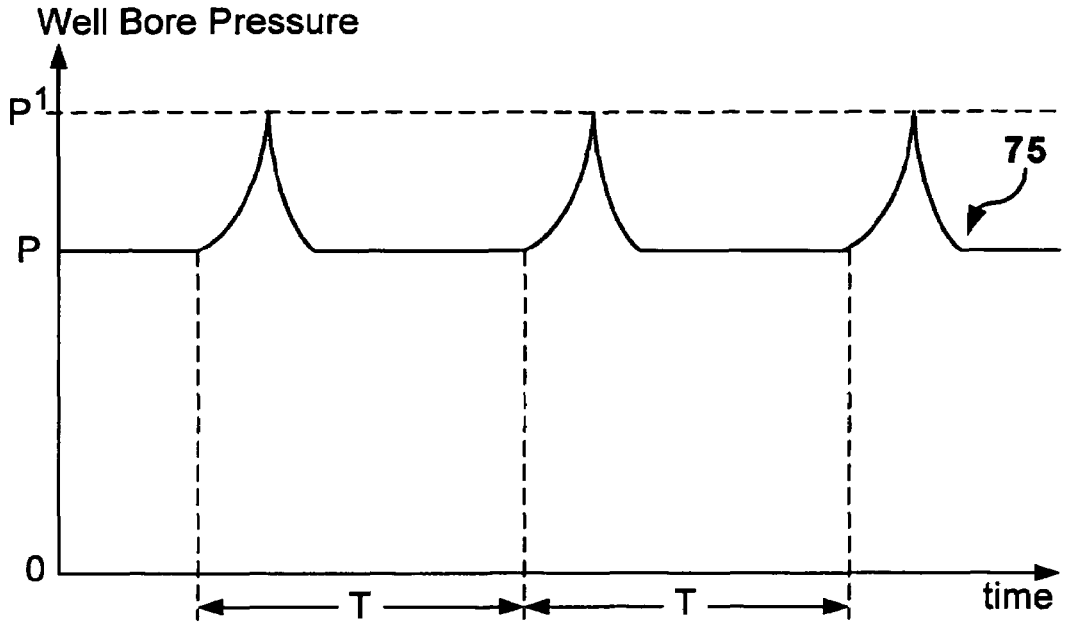
FIG. 6 is a graphical depiction of an amplitude and a frequency of a pressure pulse which may be produced within a subterranean well bore by an exemplary embodiment of an apparatus of the present invention when used with a method of the present invention.
Figure 7:
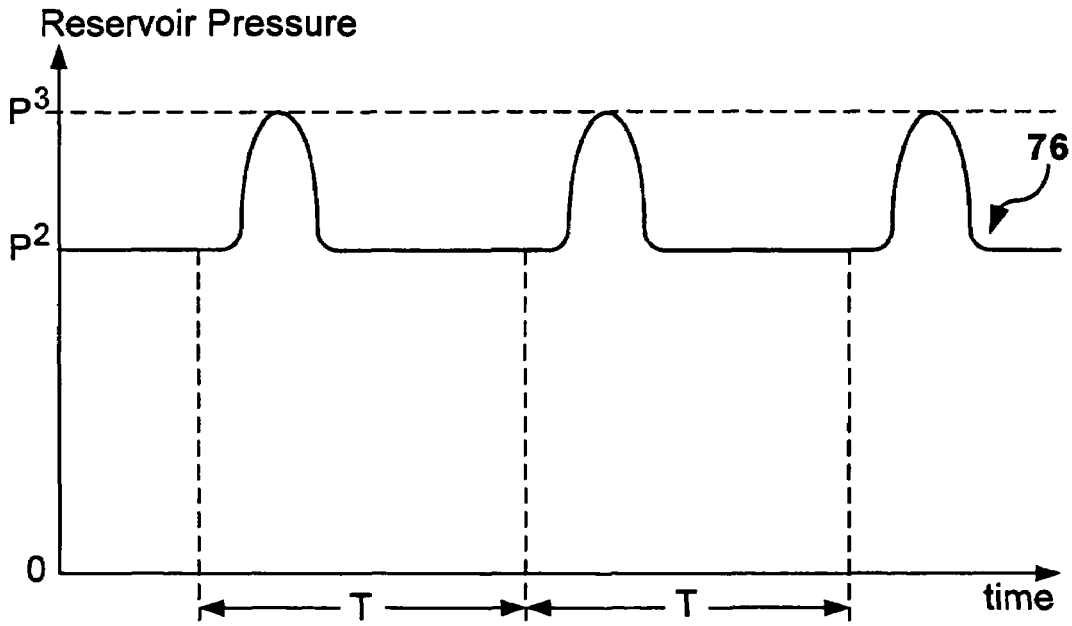
FIG. 7 is a graphical depiction of an amplitude and a frequency of a pressure pulse which may be produced within a subterranean reservoir by an exemplary embodiment of an apparatus of the present invention when used with a method of the present invention.

FIGS. 6 and 7 depict embodiments of the typical changes in pressure seen in a portion of a subterranean well bore formation before and after pressure pulsing. As seen in FIG. 6, well bore pressure 75 initially demonstrates a positive pressure P, due to, inter alia, continuous injection of fluid into the well bore. A pressure pulse is then performed at the surface while the resin composition is being injected. When the pressure pulse is delivered, well bore pressure 75 is elevated to a pulsed pressure $P^1$ for the entire duration of the pulse. Generally, pulsed pressure $P^1$ is a pressure sufficient to at least partially dilate the pore spaces in the portion of the formation being treated to increase fluid mobility and temporarily lower the capillary pressure in the formation. Pulsed pressure $P^1$ generally ranges from about 10 psi to about 3,000 psi. After the pulse, well bore pressure 75 returns to its original pressure P. After a time (T), the pulse is repeated; the pulse therefore has a frequency of 1/T. Generally, the frequency is a frequency sufficient to encourage the consolidation fluid to substantially uniformly enter the pore spaces of the formation. Generally, the frequency ranges from about 0.001 Hz to about 1 Hz. FIG. 7 depicts an exemplary embodiment of reservoir pressure 76 during the same period of time. As seen in FIG. 2, reservoir pressure 76 demonstrates a positive pressure $p^2$ due to, inter alia, continuous injection of the consolidation fluid into a portion of the subterranean formation. After a pressure pulse is delivered at the surface by the apparatus and methods of the present invention, reservoir pressure 76 rises to a pulsed pressure $P^3$ for a duration approaching the duration of the pulse. Reservoir pressure 76 then gradually returns to its original pressure $p^2$. The dampening effect of the fluid in the subterranean reservoir may be seen by comparing the relatively sharp changes in well bore pressure 75 depicted in FIG. 1 with the more gradual changes in reservoir pressure 76 depicted in FIG. 2.

II. Devices that Create Pressure Pulse/Vibrational Energy

While any method capable of providing pressure or vibrational energy is suitable in the placement methods of the present invention, one suitable method involves the use of a fluidic oscillator. Fluidic oscillators create pressure changes that may be used to induce cyclical stresses (pressure pulses) in a subterranean formation. In such methods, the treatment fluid enters a switch body and is accelerated into a fluidic oscillator device. Examples of suitable fluidic oscillators are provided in U.S. Pat. Nos. 5,135,051, 5,165,438, and 5,893,383. Generally, in such devices, the treatment fluid stream enters the oscillator and preferentially attaches to the outer wall of one of the fluid passageways and continues down the selected passageway to the outlet. As the flow passes a cross channel, a low pressure area is created which causes the main fluid stream to be interrupted and the flow to switch and attach to the other fluid passageway. The switch begins to oscillate which causes alternating "bursts" of fluid to be ejected into the well bore. As each "burst" is ejected, it forms a compression wave within the well bore fluid. As the wave passes through the formation and is reflected back, it induces dilation on the porosity of the formation matrix. Generally, the use of high frequency, low amplitude pressure pulses will focus energy primarily in the near wellbore region while low frequency, high amplitude pressure pulses may be used to achieve deeper penetration.

FIGS. 1–5 describe particular devices and systems suitable for use in generating the pressure or vibrational energy used in the methods of the present invention. While the devices described by FIGS. 1–5 are suitable, any other devices known in the art may also be used.

Figure 1:
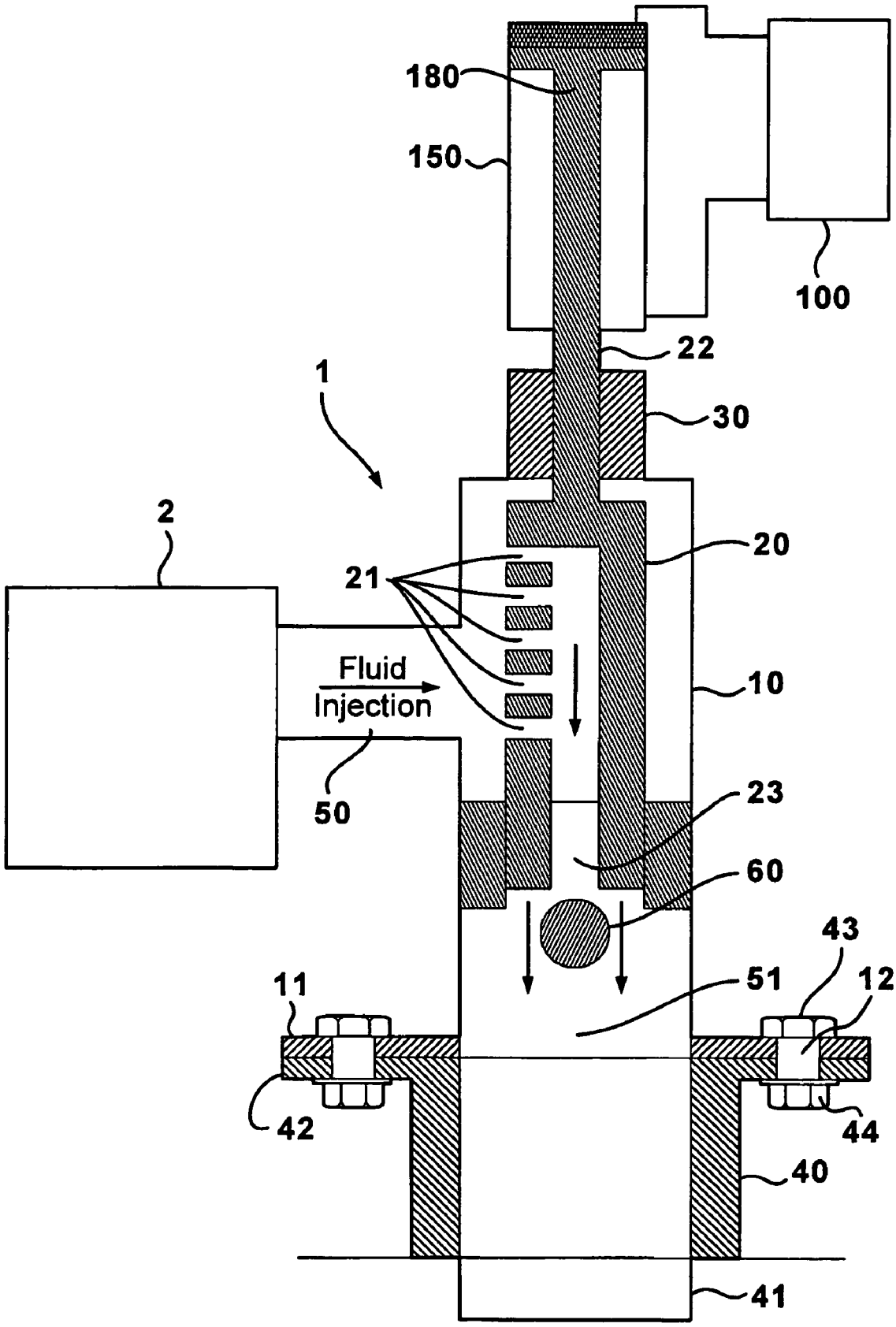
FIG. 1 is a side cross-sectional view of an exemplary embodiment of an apparatus of the present invention assembled atop a well head, with a plunger in normal operating position.
Figure 2:
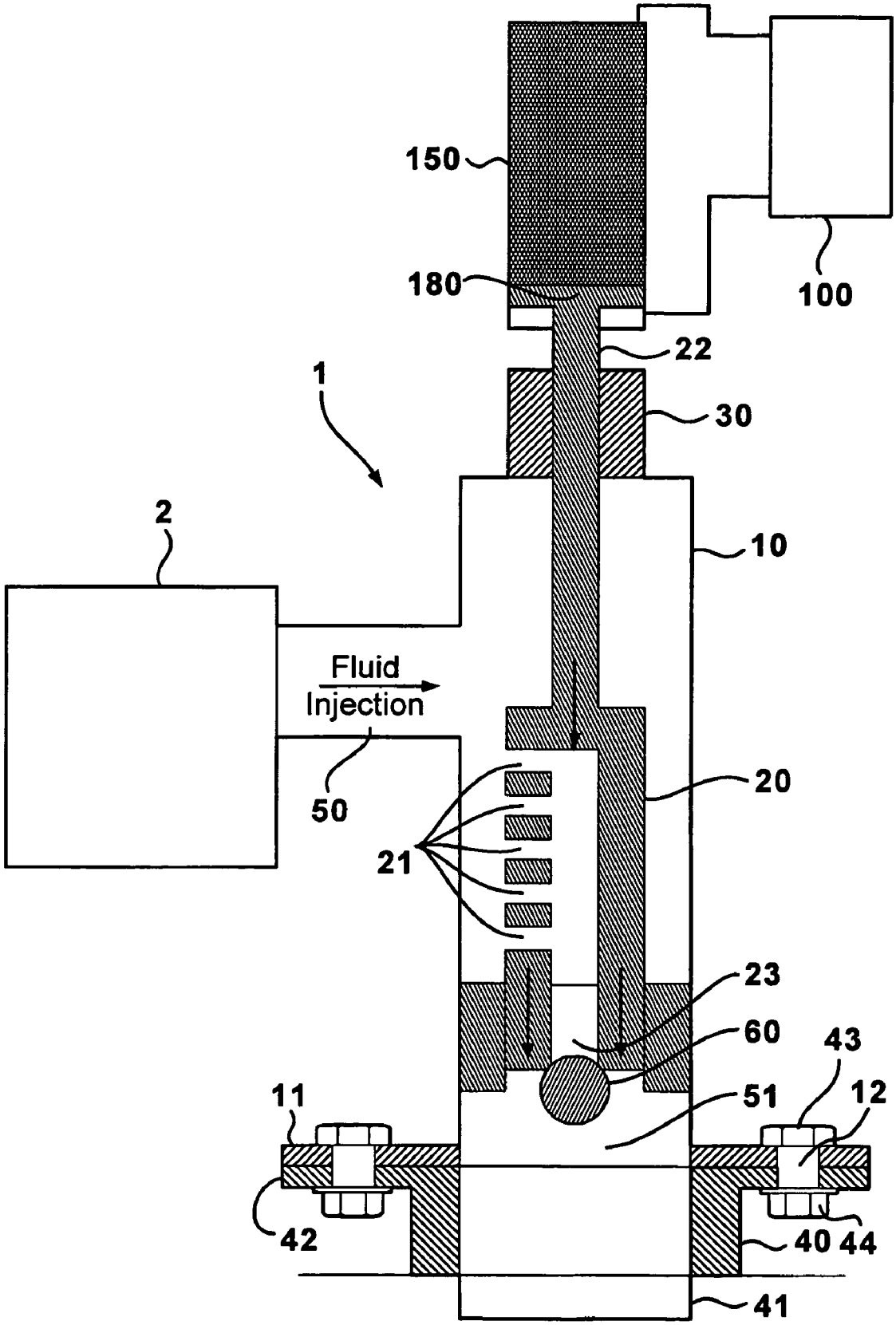
FIG. 2 is a side cross-sectional view of an exemplary embodiment of an apparatus of the present invention assembled atop a well head, with a plunger fully downstroked.

Referring to FIG. 1, an exemplary embodiment of an apparatus of the present invention is illustrated and designated generally by the numeral 1. In the embodiment depicted in FIG. 1, apparatus 1 is connected directly to well head 40. Apparatus 1 has housing 10 connected to well head 40 rising out of the uppermost end of subterranean well bore 41. Housing 10 may be connected to well head 40 in any suitable manner by a wide variety of connective devices. In certain embodiments, housing 10 may be connected to well head 40 by means of flanges. In such embodiments, housing 10 has lower flange 11, which lower flange 11 is mated to upper flange 42 of well head 40. Where flanges are used to connect housing 10 to well head 40, bolts 43 extend upward from upper flange 42, complimentary holes 12 are formed through lower flange 11 for receiving bolts 43, and nut 44 is threaded on each bolt 43 for fastening housing 10 to well head 40. One of ordinary skill in the art, with the benefit of this disclosure, will recognize that other equivalent connective devices may be employed.

Referring again to FIG. 1, a plunger 20 is disposed within housing 10. Plunger 20 is connected to upper stem 22. Upper stem 22 extends upward through housing 10 and is sealed by seal assembly 30 which, inter alia, prevents the contents of housing 10 from leaking around upper stem 22. Upper stem 22 extends through seal assembly 30 and connects to ram 180 within cylinder 150. Cylinder 150 is connected to power pack assembly 100, as shown in greater detail in FIGS. 3, 4 and 5. Power pack assembly 100, and its operation, will be further described later in this specification.

Referring to FIG. 1, housing 10 has a fluid injection port 50, through which a fluid that will be pressure pulsed enters apparatus 1. A fluid injection device 2 injects fluid continuously into fluid injection port 50. A wide variety of positive head or positive displacement devices may be suitable for use as fluid injection device 2, including, for example, a storage vessel (for example, a water tower) which discharges fluid via gravity, a pump, and the like. One of ordinary skill in the art, with the benefit of this disclosure, will recognize the appropriate type of fluid injection device 2 for a particular application. In certain embodiments where fluid injection device 2 is a pump, a wide variety of pumps may be used, including but not limited to centrifugal pumps and positive displacement pumps.

Figure 9:
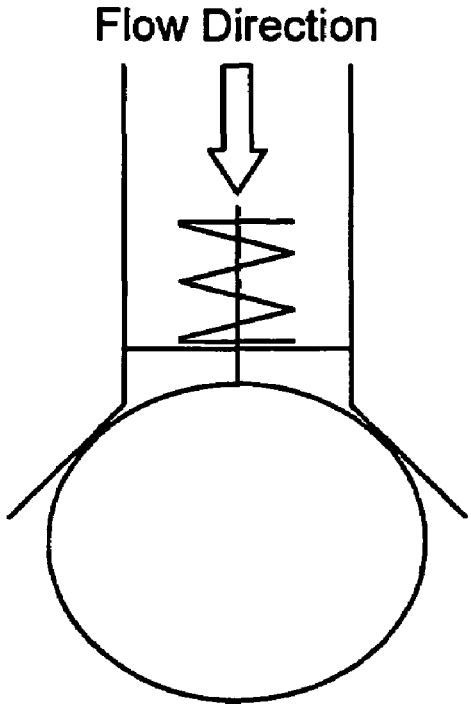
FIG. 9 is a side cross-sectional view of an exemplary embodiment of a ball check valve that may be used in an embodiment of an apparatus of the present invention.
Figure 10:
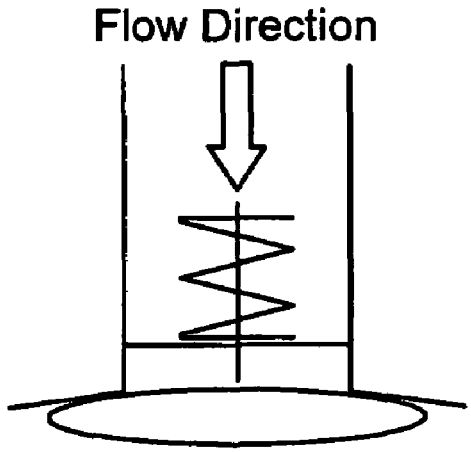
FIG. 10 is a side cross-sectional view of an exemplary embodiment of a dart check valve that may be used in an embodiment of an apparatus of the present invention.
Figure 11:
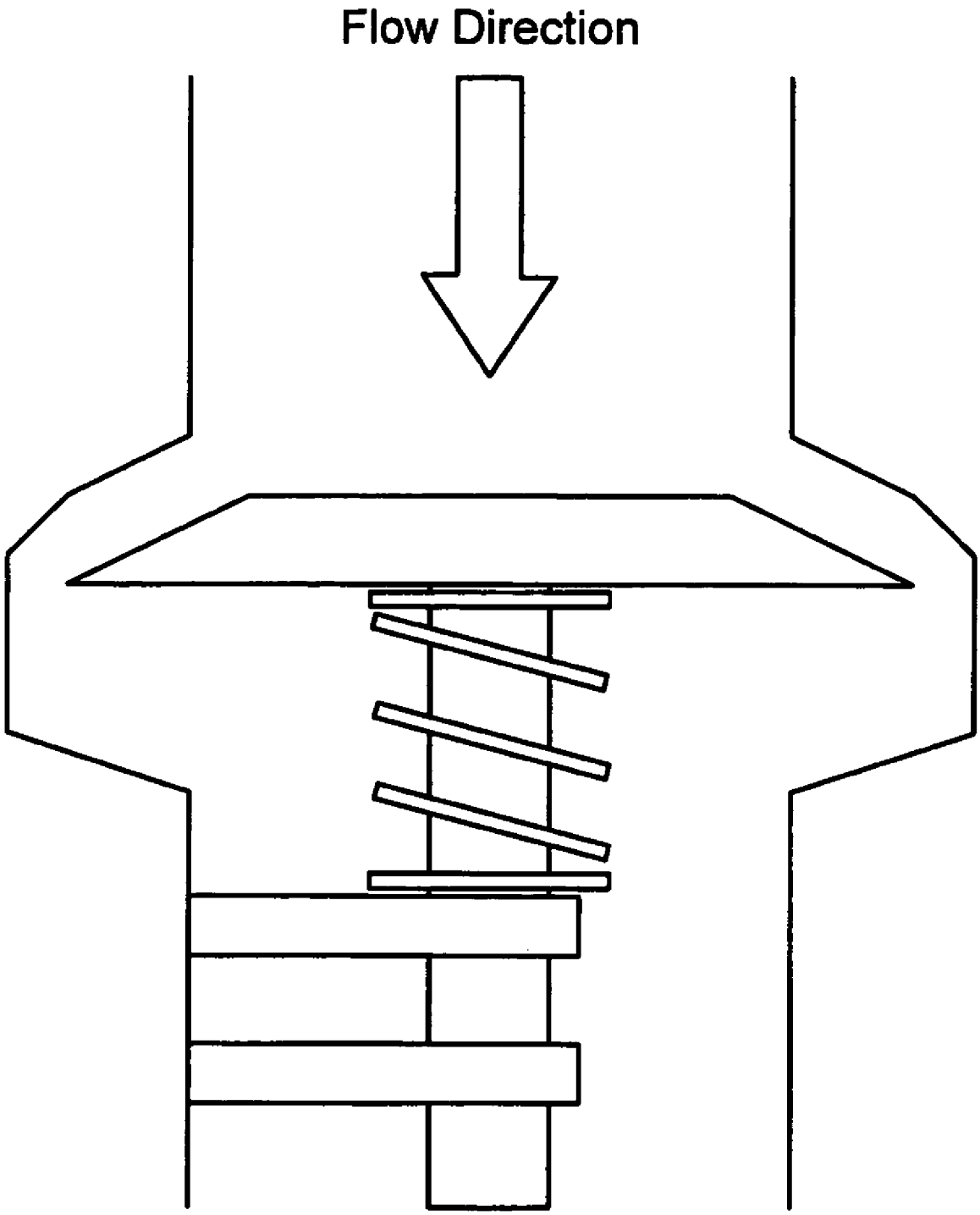
FIG. 11 is a side cross-sectional view of an exemplary embodiment of a spring-loaded check valve that may be used in an embodiment of an apparatus of the present invention.

In the exemplary embodiment depicted in FIG. 1, the fluid which fluid injection device 2 injects continuously into fluid injection port 50 enters plunger 20 through openings 21, which in certain preferred embodiments are disposed along the surface of plunger 20, and which permit the fluid to enter a hollow chamber in plunger 20 and flow downwards through plunger 20 before exiting through plunger outlet 23. In certain embodiments of plunger 20, openings 21 are disposed along the surface of plunger 20 facing fluid injection port 50. Check valve 60 is located within housing 10 a short distance below plunger 20. Outlet port 51 is located below check valve 60. A wide variety of check-type valves may be suitable for use as check valve 60. For example, check valve 60 may be a ball check valve, a dart check valve, a spring-loaded check valve, or other known equivalent device. Exemplary embodiments of ball, dart, and spring-loaded check valves are illustrated by FIGS. 9, 10 and 11, respectively.

Returning to the exemplary embodiment illustrated by FIG. 1, during normal operation, check valve 60 is not seated against plunger outlet 23, i.e., check valve 60 is normally open so as to permit the fluid which is continuously entering apparatus 1 through fluid injection port 50 to exit apparatus 1 through plunger outlet 23. When a pressure pulse is called for, however, power pack assembly 100 applies a downward force on ram 180 located within cylinder 150. Ram 180 is connected by upper stem 22 to plunger 20; accordingly, the downward motion of ram 180 applies a downward force upon plunger 20, causing plunger outlet 23 to seat against check valve 60, as depicted in FIG. 2. Continued downward motion of ram 180 compresses the fluid located within the housing 10 below plunger 20, briefly elevating the amplitude of the pressure of the fluid being injected into well bore 41, resulting in a pressure pulse. An exemplary embodiment of an amplitude and a frequency of a pressure pulse are illustrated in FIGS. 6 and 7. After the pulse has been generated, power pack assembly 100 applies an upward force on ram 180, thereby raising upper stem 22 and plunger 20, thus raising plunger 20 within housing 10, unseating plunger outlet 23 from check valve 60, and returning apparatus 1 to normal operating position as depicted in FIG. 1. Power pack assembly 100, and its operation, will be further described later in this specification.

FIG. 2 depicts an exemplary embodiment of an apparatus of the present invention with plunger 20 fully downstroked, and with plunger outlet 23 shown seated against check valve 60. Generally, plunger outlet 23 seats against check valve 60 for a time sufficient to generate a pressure pulse within well bore 41. In certain preferred embodiments, the time required to generate a pressure pulse is sufficiently small that plunger outlet 23 seats against check valve 60 for a time such that fluid injection through plunger outlet 23 into well bore 41 is effectively continuous. As FIG. 2 demonstrates, fluid pumped by fluid injection device 2 through fluid injection port 50 continually enters plunger 20 through openings 21, even when plunger 20 is fully downstroked. This facilitates the use of any device as fluid injection device 2, including but not limited to a positive displacement pump whose discharge cannot ordinarily be interrupted without risk of overpressuring a component of the flow system.

Figure 8:
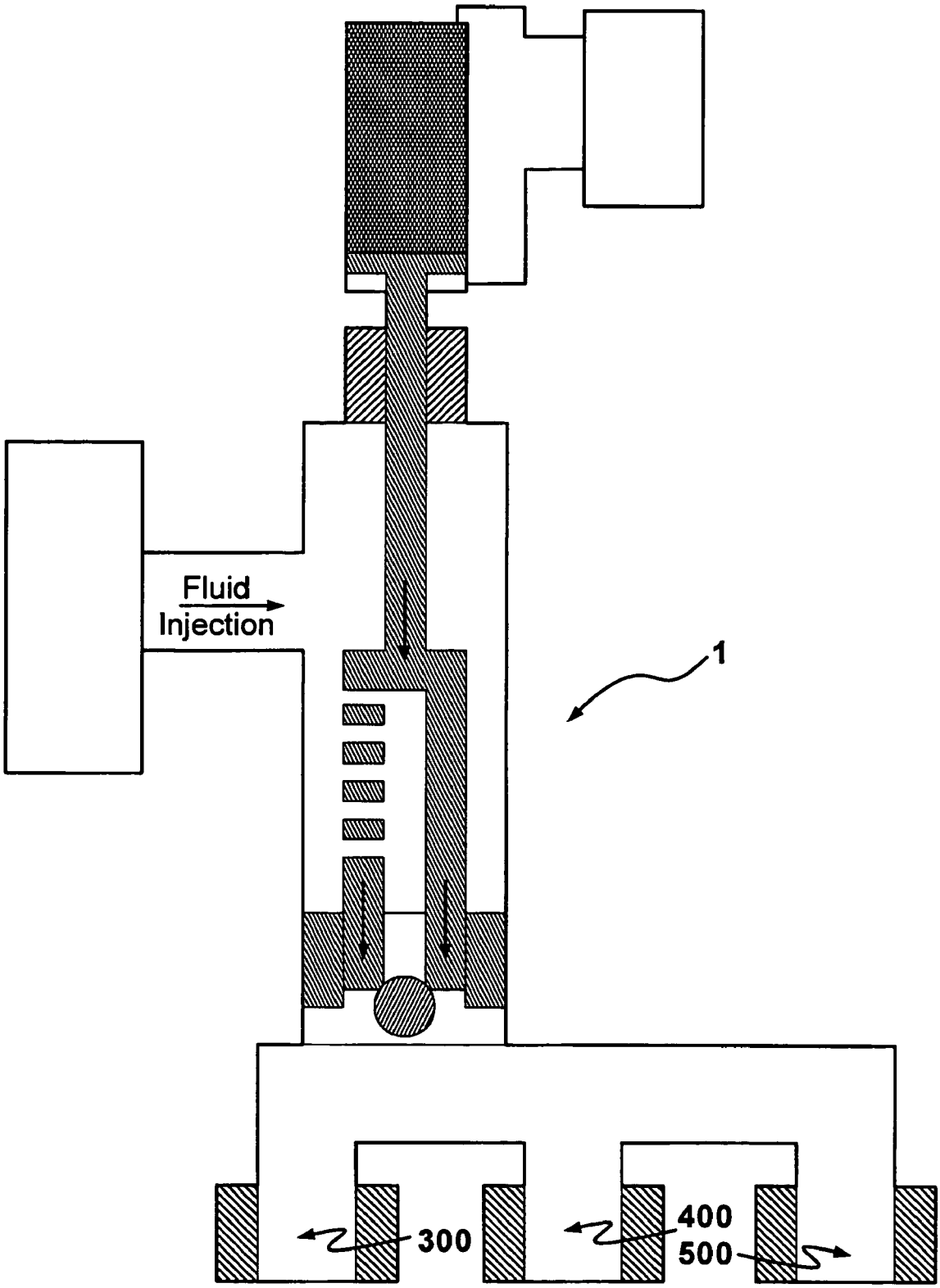
FIG. 8 is a block diagram depicting an exemplary embodiment of an apparatus of the present invention connected to a network of well heads.

Accordingly, the pressure pulse generated by the apparatus 1 of the present invention is generated at the surface, and then propagates through well bore 41. Among other benefits, this permits the apparatus 1 to be networked so as to pressure pulse multiple wells, as depicted in the exemplary embodiment illustrated in FIG. 8, where a single apparatus 1 is shown networked to pressure pulse well bores 300, 400, and 500. In certain embodiments where the apparatus 1 is networked among multiple wells, the wells may be spaced as far apart as about 640 acres from each other. In embodiments where the apparatus 1 is networked among multiple wells, the proper spacing of the wells depends on a variety of factors, including but not limited to porosity and permeability of the subterranean formation, and viscosity of the hydrocarbon sought to be recovered from the formation.

Figure 3:
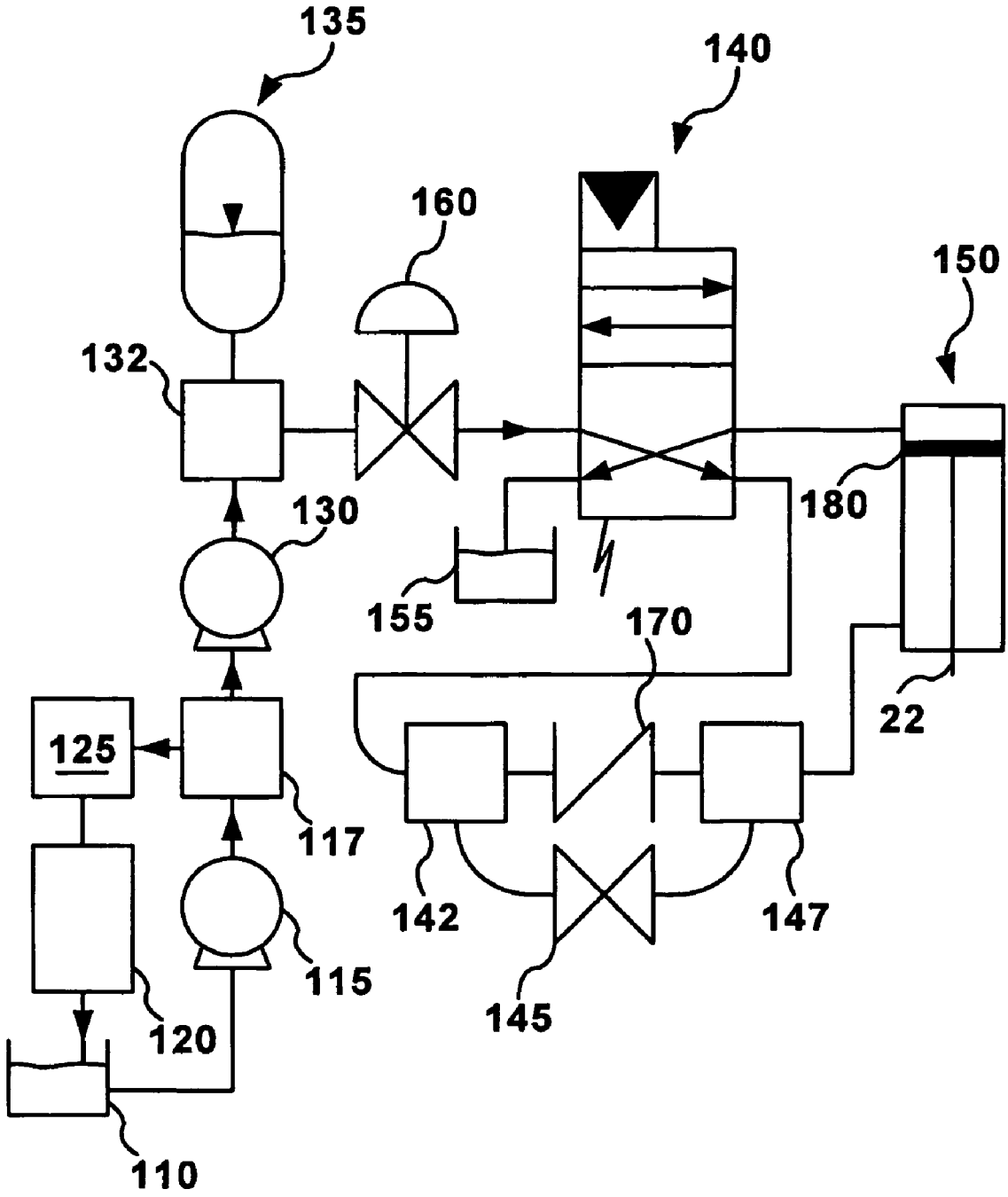
FIG. 3 is a view of an exemplary embodiment of a power pack assembly in accordance with the present invention.

FIG. 3 depicts an exemplary embodiment of power pack assembly 100. In certain preferred embodiments, power pack assembly 100 is a hydraulic power pack assembly. Optionally, power pack assembly 100 may comprise a pneumatic power pack assembly. A hydraulic power pack assembly enables pressure pulsing to be accomplished with smaller, less expensive equipment, and is thought to have improved reliability. As illustrated by FIG. 3, an exemplary embodiment of power pack assembly 100 comprises fluid supply 110, hydraulic pump 130, tee 132, accumulator 135, directional control valve 140, tee 142, upstroke control valve 145, tee 147, cylinder 150, fluid outlet 155, and one-direction bypass valve 170, connected in the manner shown in FIG. 3. Optionally, in embodiments such as those where the fluid in power pack assembly 100 is continually recirculated, power pack assembly 100 may additionally comprise charge pump 115, tee 117, filter 120, and cooler 125, connected as shown in FIG. 3. Optionally, in embodiments where the capability of altering the amplitude of the pressure pulse generated is desirable, power pack assembly 100 further comprises flow modulator 160, as shown in FIG. 3.

Fluid supply 110 comprises any source of a continuous supply of fluid which may be suitable for use in a power pack assembly. In certain embodiments of the present invention, fluid supply 110 comprises a continuous source of water. Hydraulic pump 130 comprises any device suitable for pumping fluid throughout power pack assembly 100. In certain preferred embodiments, hydraulic pump 130 comprises a variable displacement pump. Each of tee 117, tee 132, tee 142, and tee 147 comprises any device capable of permitting at least a portion of a fluid stream to flow along either of two flow paths, following the path of least resistance. In certain preferred embodiments, such tees comprise a T-shaped fitting.

Accumulator 135 is any container having the capability of storing fluid under pressure as a source of fluid power. In certain embodiments, accumulator 135 comprises a gas-charged or a spring-charged pressure vessel. In embodiments where accumulator 135 comprises a gas-charged pressure vessel, the fluid flow into accumulator 135 enters below the gas-liquid interface. While accumulator 135 may be spatially oriented either horizontally or vertically, in certain preferred embodiments, accumulator 135 is oriented vertically. In embodiments where accumulator 135 is a gas-charged pressure vessel, accumulator 135 may be charged with any compressible gas; in certain preferred embodiments, nitrogen is used. Among other functions, accumulator 135 dampens pressure increases which may occur, depending on, inter alia, the position of directional control valve 140. Accumulator 135 also acts as, inter alia, an energy storage device by accepting a portion of the fluid flowing from tee 132, inter alia, for time periods when the volume of cylinder 150 below ram 180 is full of fluid, and plunger 20 (connected to ram 180 by upper stem 22) resides in a fully upstroked position prior to delivering a pressure pulse.

Directional control valve 140 comprises any valve capable of directing the flow of two fluid streams through selected paths. At any given time, directional control valve 140 will comprise two flow paths that accept flow from two sources, and direct flow to two destinations. Further, directional control valve 140 is capable of being repositioned among a first position (which creates two flow paths "A" and "B," which serve a first set of source-destination combinations), and a second position (which creates two flow paths "C" and "D," which serve a second set of source-destination combinations). For example, in an exemplary embodiment illustrated in FIG. 4, directional control valve 140 is positioned in a first position, and accepts flow of a fluid stream from a source, tee 132, and directs this stream through a path "A" within directional control valve 140 towards a destination, tee 142. Simultaneously, in this exemplary embodiment, directional control valve 140 accepts flow of a fluid stream from another source, the top of cylinder 150, and directs this stream through a path "B" within directional control valve 140 towards a destination, fluid outlet 155. When directional control valve 140 is repositioned to a second position, as illustrated by the exemplary embodiment illustrated in FIG. 5, directional control valve 140 accepts flow of a fluid stream from a source, tee 132, and directs this stream through a path "C" within directional control valve 140 towards a destination, the top of cylinder 150. Simultaneously, in this exemplary embodiment illustrated in FIG. 5, directional control valve 140 accepts flow of a fluid stream from a source, the base of cylinder 150, and directs this stream through a path "D" within directional control valve 140 towards a destination, fluid outlet 155. In certain preferred embodiments, directional control valve 140 is a four-way, two-position, single actuator, solenoid-operated control valve. An example of a suitable directional control valve is commercially available from Lexair, Inc., of Lexington, Ky. In certain preferred embodiments, directional control valve 140 is programmed to reposition itself among the first and the second position at a desired frequency. Inter alia, such programming of directional control valve 140 permits a fluid stream to be directed either into the top of cylinder 150 (thereby downstroking ram 180 within cylinder 150) or into the base of cylinder 150 (thereby upstroking ram 180 within cylinder 150), at a desired frequency. Inter alia, this permits plunger 20 (connected to ram 180 by upper stem 22) to be upstroked and downstroked at a desired frequency.

Figure 4:
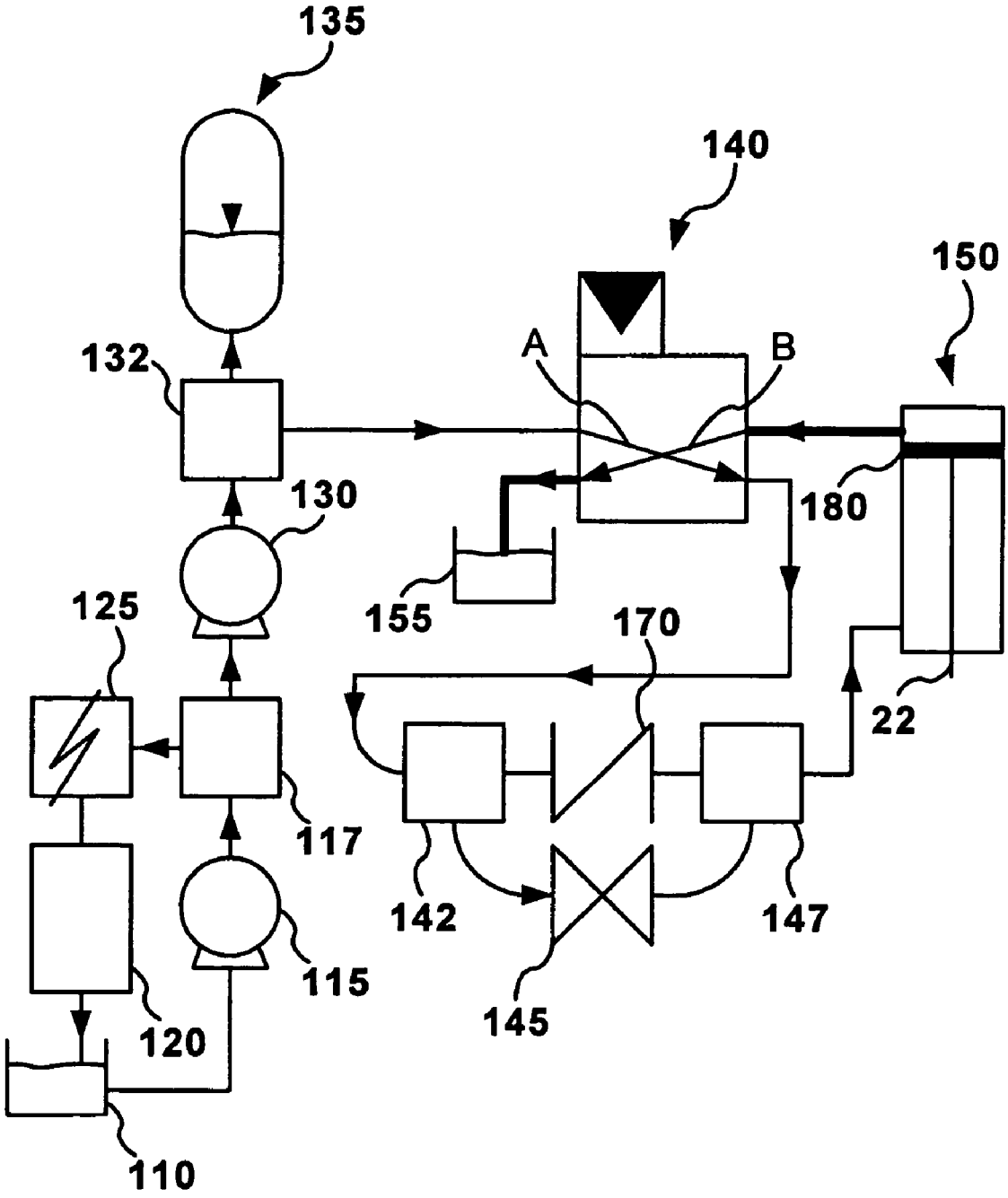
FIG. 4 is a view of an exemplary embodiment of a power pack assembly in accordance with the present invention.

Upstroke control valve 145 is any device which provides the capability to modulate fluid flow to a desired degree. In certain preferred embodiments, upstroke control valve 145 is a modulating control valve, having positions ranging from about fully open to about fully closed. One-direction bypass valve 170 is a check valve permitting fluid to flow in only one direction. In the exemplary embodiment of power pack assembly 100 depicted in FIGS. 3, 4, and 5, one-direction bypass valve 170 is installed so that, inter alia, it permits fluid supplied from tee 147 to flow through one-direction bypass valve 170 towards tee 142, but does not permit flow in the reverse direction (i.e., it does not accept fluid supplied from tee 142). As illustrated by FIG. 4, fluid flowing from tee 142 arrives at the base of cylinder 150 by passing through upstroke control valve 145, but not one-direction bypass valve 170, because only upstroke control valve 145 accepts flow supplied from tee 142. Accordingly, in the exemplary embodiment shown in FIG. 4, the position of upstroke control valve 145 controls the rate at which fluid flows into the base of cylinder 150, thereby, inter alia, impacting the rate of upstroke of ram 180 within cylinder 150. Because ram 180 is connected to plunger 20 by upper stem 22, upstroke control valve 145, inter alia, modulates the rate of upstroke of plunger 20. In certain preferred embodiments, upstroke control valve 145 is adjusted to control the rate of upstroke of plunger 20 to a rate sufficiently slow that the upstroke of plunger 20 does not apply a negative pressure on the reservoir or allow the pressure in well bore 41 to drop below the reservoir pressure during the time interval between pressure pulse cycles. Referring now to the exemplary embodiment shown in FIG. 5, fluid flowing out of the base of cylinder 150 and through tee 147 is permitted to flow through both one-direction bypass valve 170 and upstroke control valve 145, inter alia, because one-direction bypass valve 170 does accept flow supplied from tee 147. Accordingly, in the exemplary embodiment illustrated by FIG. 5, fluid may be displaced rapidly from the base of cylinder 150 by flowing through both upstroke control valve 145 as well as through one-direction bypass valve 170. Because the rate at which fluid is displaced from the base of cylinder 150 impacts the speed with which ram 180 is downstroked within cylinder 150, the parallel installation of one-direction bypass valve 170 and upstroke control valve 145, inter alia, facilitates very rapid downstroking of plunger 20 (connected to ram 180 by upper stem 22).

Fluid outlet 155 is any means by which fluid may exit power pack assembly 100. In certain optional embodiments wherein the fluid circulating through power pack assembly 100 is continuously recirculated, fluid outlet 155 may be connected to fluid supply 110. In such optional embodiments, the power pack assembly 100 may further comprise charge pump 115, tee 117, filter 120, and cooler 125. Charge pump 115 comprises any device suitable for providing positive pressure to the suction of hydraulic pump 130. Charge pump 115 may be driven by, inter alia, diesel or electric power. Cooler 125 is any device capable of maintaining the recirculating fluid at a desired temperature. In certain preferred embodiments, cooler 125 comprises a heat exchanger. Filter 120 is any device suitable for removal of undesirable particulates within the recirculating fluid.

Flow modulator 160 may be present in optional embodiments wherein, inter alia, it is desired to control the amplitude of the pressure pulse generated. Flow modulator 160 is any device that provides the capability to modulate fluid flow to a desired degree. In certain embodiments, flow modulator 160 is a computer-controlled flow control valve. Flow modulator 160 is used, inter alia, to modulate the flow rate of fluid supplied from tee 132 through directional control valve 140 into the top of cylinder 150, inter alia, to modulate the rate at which plunger 20 (connected to ram 180 by upper stem 22) is downstroked, inter alia, to control the amplitude of the pressure pulse generated to within a desired maximum amplitude. In certain embodiments where, inter alia, flow modulator 160 is computer-controlled, the desired amplitude may be achieved under a variety of conditions.

Figure 5:
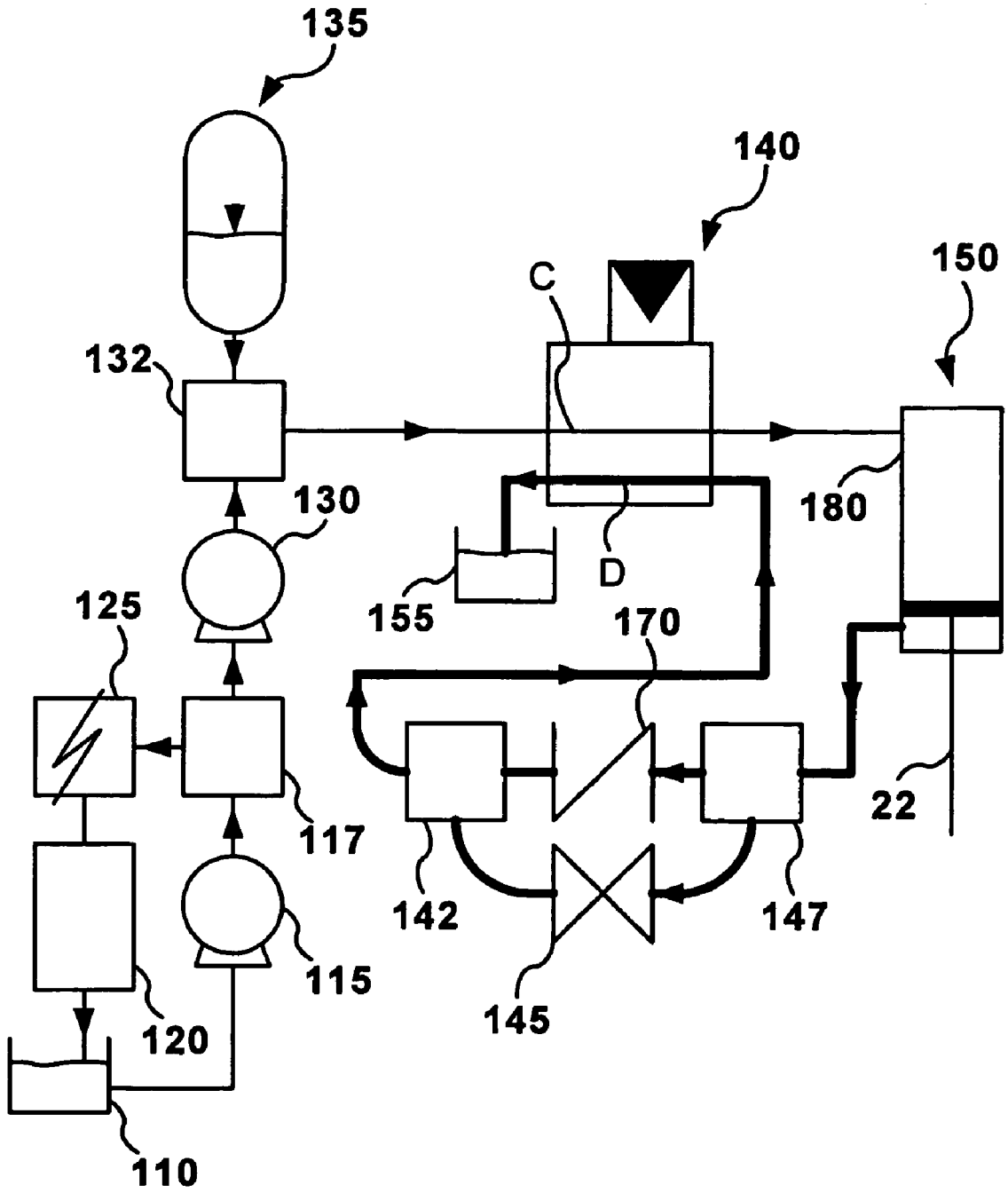
FIG. 5 is a view of an exemplary embodiment of a power pack assembly in accordance with the present invention.

FIG. 4 illustrates an exemplary embodiment of a flow diagram for the relevant streams in power pack assembly 100 under normal operating conditions, e.g., where plunger 20 (connected to ram 180 by upper stem 22) is upstroked, or is in the process of being upstroked. FIG. 5 illustrates an exemplary embodiment of a flow diagram for the relevant streams in power pack assembly 100 under pressure pulsing conditions, e.g., where plunger 20 (connected to ram 180 by upper stem 22) is downstroked or is in the process of being downstroked. Referring now to FIG. 4, fluid supply 110 is shown supplying hydraulic pump 130. The discharge from hydraulic pump 130 flows to tee 132. A portion of the flow from tee 132 flows to accumulator 135, inter alia, building additional pressure and volume within power pack assembly 100. The portion of the fluid entering tee 132 which does not enter accumulator 135 flows to directional control valve 140. As will be recalled, directional control valve 140 is capable of being repositioned among the first position (which creates two flow paths "A" and "B," which serve the first set of source-destination combinations), and the second position (which creates two flow paths "C" and "D," which serve the second set of source-destination combinations). As shown in FIG. 4, under normal conditions, path "A" of directional control valve 140 permits fluid to supply the base of cylinder 150. Therefore, as illustrated by FIG. 4, fluid normally flows from tee 132 into path "A" of directional control valve 140, and thereafter into tee 142. From tee 142, fluid flows solely through upstroke control valve 145, because one-direction bypass valve 170 is a one-way check valve which does not accept flow from tee 142. From upstroke control valve 145, fluid flows through tee 147 and into the base of cylinder 150, imparting an upward pressure upon ram 180 within cylinder 150 by keeping the volume of cylinder 150 below ram 180 full of fluid, maintaining ram 180 (and, thereby, plunger 20) in an upstroked position. As FIG. 4 illustrates, path "B" of directional control valve 140 is orientated under normal conditions so as to connect the top of cylinder 150 with fluid outlet 155, represented by the flow stream indicated by heavy black lines. Where plunger 20 is in the process of being upstroked, all fluid within cylinder 150 above ram 180 exits the top of cylinder 150, and flows through path "B" of directional control valve 140, and into fluid outlet 155. Once plunger 20 arrives at a fully upstroked position, cylinder 150 will be full of fluid, and all fluid above ram 180 will have already been displaced through the top of cylinder 150; therefore, once plunger 20 is fully upstroked, no fluid flows through path "A" or path "B" of directional control valve 140 until after a pressure pulse has been delivered and plunger 20 must once more be upstroked. Rather, once plunger 20 is fully upstroked, flow from tee 132 accumulates in accumulator 135 until a pressure pulse is to be delivered. In certain embodiments, the speed of hydraulic pump 130, the position of upstroke control valve 145, and the frequency at which directional control valve 140 repositions itself may be coordinated so that a pressure pulse is delivered within a desired time after plunger 20 has been fully upstroked. One of ordinary skill in the art, with the benefit of this disclosure, will be able to recognize how such coordination may be accomplished.

FIG. 5 illustrates an exemplary embodiment of power pack assembly 100 during the delivery of a pressure pulse. From FIG. 5, it will be seen that when it is desired to downstroke ram 180 (and, thereby, plunger 20), thereby generating a pressure pulse, directional control valve 140 changes positions such that path "C" of directional control valve 140 permits fluid to flow from tee 132 into the top of cylinder 150, whereas path "D" accepts fluid displaced from the base of cylinder 150 and permits it to flow into fluid outlet 155. In certain embodiments, directional control valve 140 changes positions in response to a signal from a computer controller; in certain other embodiments, the position of directional control valve 140 may be manually changed. In FIG. 5, the flow of fluid displaced from the base of cylinder 150 is represented by the flow stream indicated by heavy black lines. When it is desired to downstroke ram 180 (and, thereby, plunger 20), fluid flows from tee 132 through path "C" of directional control valve 140, and enters cylinder 150 above ram 180, thereby imparting a downward pressure upon ram 180 (and downstroking plunger 20), and displacing the fluid below ram 180 within cylinder 150. This displaced fluid flows into tee 147, and flows through both upstroke control valve 145 and one-direction bypass valve 170, following the path of least resistance. Inter alia, the flow of fluid displaced from the base of cylinder 150 through both one-direction bypass valve 170 and upstroke control valve 145 assists in removing the displaced fluid as rapidly as possible, thereby, inter alia, permitting ram 180 within cylinder 150 to be downstroked as rapidly as possible, thereby, inter alia, permitting plunger 20 (connected to ram 180 by upper stem 22) to generate a pressure pulse as rapidly as possible. Additional fluid volume and pressure stored in accumulator 135 assist in further increasing the speed of the downstroke by flowing through tee 132, then through path "C" of directional control valve 140 into the top of cylinder 150. The displaced fluid flowing through upstroke control valve 145 and one-direction bypass valve 170 then enters tee 142, flows through path "D" of directional control valve 140 and into fluid outlet 155. In certain embodiments, such as those where it is desired to control the speed of the downstroke, flow modulator valve 160 may be installed, inter alia, to modulate the flow of fluid from tee 132 to path "C" of directional control valve 140, thereby, inter alia, controlling the speed of the downstroke to a desired speed.

When the pressure pulse has been generated and plunger 20 is to be returned to its upstroked position, directional control valve 140 changes positions again such that, as has been previously discussed and as will be seen from FIG. 4, fluid flows from tee 132 through path "A" of directional control valve 140 and ultimately into the base of cylinder 150, whereas path "B" of directional control valve 140 accepts fluid displaced from the top of cylinder 150 and permits it to flow into fluid outlet 155. In certain preferred embodiments, upstroke control valve 145 is adjusted to control the rate of upstroke of plunger 20 to a rate sufficiently slow that the upstroke of plunger 20 does not apply a negative pressure on the reservoir or allow the pressure in well bore 41 to drop below the reservoir pressure during the time interval between pressure pulse cycles.

Returning to FIG. 3, other features of the power pack assembly 100 may be seen. In certain optional embodiments wherein the circulating fluid is continuously recirculated (e.g., where fluid exiting fluid outlet 155 returns to fluid supply 110), fluid supply 110 supplies fluid to charge pump 115, which discharges fluid to tee 117. One of the fluid streams exiting tee 117 supplies cooler 125, and the other fluid stream exiting tee 117 supplies hydraulic pump 130. The fluid stream exiting cooler 125 then passes through filter 120 and then returns to fluid supply 110.

Certain embodiments of power pack assembly 100 provide the capability of, inter alia, varying the rate at which ram 180 is downstroked within cylinder 150, thereby, inter alia, varying the force applied to plunger 20 (connected to ram 180 by upper stem 22); this, inter alia, varies the amplitude of the corresponding pressure pulse which is generated. In certain of such embodiments where the capability of altering the amplitude of the pressure pulse generated is desirable, the discharge from tee 132 flows to flow modulator 160, as shown in FIG. 3. In certain embodiments of the present invention, the amplitude of each pressure pulse may be tightly controlled to within about 10 psi of a target pressure. In certain of these latter embodiments, flow modulator 160 receives a continuous signal from a pressure transmitter located within well bore 41, which signal communicates the pressure in well bore 41; when a pressure pulse is to be delivered, flow modulator 160 then modulates the flow of fluid in accordance with the desired amplitude of the pressure pulse, and the pressure in well bore 41. One of ordinary skill in the art, with the benefit of this disclosure, will understand how flow modulator 160 may be programmed so that a pressure pulse of a given amplitude may be generated. Among other benefits, this enables the systems and methods of the present invention to be advantageously used even in subterranean formations where only a narrow difference, e.g., less than about 50 psi, exists between the reservoir pressure and the pressure which would fracture the reservoir. Generally, the pressure pulse will have an amplitude sufficient to propagate a dilatancy wave that propagates into the reservoir at the crest of the pressure pulse. More particularly, the pressure pulse will have an amplitude in the range of from about 10 psi to about 3,000 psi. In preferred embodiments, the pressure pulse will have an amplitude in the range of about 50% to about 80% of the difference between fracture pressure and reservoir pressure. In some embodiments, the apparatus and methods of the present invention may be used to generate pressure pulses with an amplitude exceeding the fracture pressure of the reservoir, where such fracturing is desirable.

III. Consolidation Fluids Suitable for Use in the Present Invention

Consolidation fluids suitable for use in the present invention generally comprise a resin and at last one of a tackifying agent, curable resin, a gelable composition, or a combination thereof. In some embodiments of the present invention, the viscosity of the consolidation fluid is controlled to less than about 100 cP, preferably less than about 50 cP, and still more preferably less than about 10 cP.

A. Consolidation Fluids—Tackifying Agents

Tackifying agents suitable for use in the consolidation fluids of the present invention comprise any compound that, when in liquid form or in a solvent solution, will form a non-hardening coating upon a particulate. A particularly preferred group of tackifying agents comprise polyamides that are liquids or in solution at the temperature of the subterranean formation such that they are, by themselves, non-hardening when introduced into the subterranean formation. A particularly preferred product is a condensation reaction product comprised of commercially available polyacids and a polyamine. Such commercial products include compounds such as mixtures of $C_{36}$ dibasic acids containing some trimer and higher oligomers and also small amounts of monomer acids that are reacted with polyamines. Other polyacids include trimer acids, synthetic acids produced from fatty acids, maleic anhydride, acrylic acid, and the like. Such acid compounds are commercially available from companies such as Witco Corporation, Union Camp, Chemtall, and Emery Industries. The reaction products are available from, for example, Champion Technologies, Inc. and Witco Corporation. Additional compounds which may be used as tackifying compounds include liquids and solutions of, for example, polyesters, polycarbonates and polycarbamates, natural resins such as shellac and the like. Other suitable tackifying agents are described in U.S. Pat. No. 5,853,048 issued to Weaver, et al. and U.S. Pat. No. 5,833,000 issued to Weaver, et al., the relevant disclosures of which are herein incorporated by reference.

Tackifying agents suitable for use in the present invention may be either used such that they form non-hardening coating or they may be combined with a multifunctional material capable of reacting with the tackifying compound to form a hardened coating. A "hardened coating" as used herein means that the reaction of the tackifying compound with the multifunctional material will result in a substantially non-flowable reaction product that exhibits a higher compressive strength in a consolidated agglomerate than the tackifying compound alone with the particulates. In this instance, the tackifying agent may function similarly to a hardenable resin. Multifunctional materials suitable for use in the present invention include, but are not limited to, aldehydes such as formaldehyde, dialdehydes such as glutaraldehyde, hemiacetals or aldehyde releasing compounds, diacid halides, dihalides such as dichlorides and dibromides, polyacid anhydrides such as citric acid, epoxides, furfuraldehyde, glutaraldehyde or aldehyde condensates and the like, and combinations thereof. In some embodiments of the present invention, the multifunctional material may be mixed with the tackifying compound in an amount of from about 0.01 to about 50 percent by weight of the tackifying compound to effect formation of the reaction product. In some preferable embodiments, the compound is present in an amount of from about 0.5 to about 1 percent by weight of the tackifying compound. Suitable multifunctional materials are described in U.S. Pat. No. 5,839,510 issued to Weaver, et al., the relevant disclosure of which is herein incorporated by reference.

Solvents suitable for use with the tackifying agents of the present invention include any solvent that is compatible with the tackifying agent and achieves the desired viscosity effect. The solvents that can be used in the present invention preferably include those having high flash points (most preferably above about 125° F.). Examples of solvents suitable for use in the present invention include, but are not limited to, butylglycidyl ether, dipropylene glycol methyl ether, butyl bottom alcohol, dipropylene glycol dimethyl ether, diethyleneglycol methyl ether, ethyleneglycol butyl ether, methanol, butyl alcohol, isopropyl alcohol, diethyleneglycol butyl ether, propylene carbonate, d'limonene, 2-butoxy ethanol, butyl acetate, furfuryl acetate, butyl lactate, dimethyl sulfoxide, dimethyl formamide, fatty acid methyl esters, and combinations thereof. It is within the ability of one skilled in the art, with the benefit of this disclosure, to determine whether a solvent is needed to achieve a viscosity suitable to the subterranean conditions and, if so, how much.

B. Consolidation Fluids—Curable Resins

Resins suitable for use in the consolidation fluids of the present invention include all resins known in the art that are capable of forming a hardened, consolidated mass. Many such resins are commonly used in subterranean consolidation operations, and some suitable resins include two component epoxy based resins, novolak resins, polyepoxide resins, phenolaldehyde resins, urea-aldehyde resins, urethane resins, phenolic resins, furan resins, furan/furfuryl alcohol resins, phenolic/latex resins, phenol formaldehyde resins, polyester resins and hybrids and copolymers thereof, polyurethane resins and hybrids and copolymers thereof, acrylate resins, and mixtures thereof. Some suitable resins, such as epoxy resins, may be cured with an internal catalyst or activator so that when pumped down hole, they may be cured using only time and temperature. Other suitable resins, such as furan resins generally require a time-delayed catalyst or an external catalyst to help activate the polymerization of the resins if the cure temperature is low (i.e., less than 250° F.), but will cure under the effect of time and temperature if the formation temperature is above about 250° F., preferably above about 300° F. It is within the ability of one skilled in the art, with the benefit of this disclosure, to select a suitable resin for use in embodiments of the present invention and to determine whether a catalyst is required to trigger curing.

Any solvent that is compatible with the resin and achieves the desired viscosity effect is suitable for use in the present invention. Preferred solvents include those listed above in connection with tackifying compounds. It is within the ability of one skilled in the art, with the benefit of this disclosure, to determine whether and how much solvent is needed to achieve a suitable viscosity.

C. Consolidation Fluids—Gelable Compositions

Gelable compositions suitable for use in the present invention include those compositions that cure to form a semi-solid, immovable, gel-like substance. The gelable composition may be any gelable liquid composition capable of converting into a gelled substance capable of substantially plugging the permeability of the formation while allowing the formation to remain flexible. As referred to herein, the term "flexible" refers to a state wherein the treated formation is relatively malleable and elastic and able to withstand substantial pressure cycling without substantial breakdown of the formation. Thus, the resultant gelled substance stabilizes the treated portion of the formation while allowing the formation to absorb the stresses created during pressure cycling. As a result, the gelled substance may aid in preventing breakdown of the formation both by stabilizing and by adding flexibility to the treated region. Examples of suitable gelable liquid compositions include, but are not limited to, (1) gelable resin compositions, (2) gelable aqueous silicate compositions, (3) crosslinkable aqueous polymer compositions, and (4) polymerizable organic monomer compositions.

1. Consolidation Fluids—Gelable Compositions—Gelable Resin Compositions

Certain embodiments of the gelable liquid compositions of the present invention comprise gelable resin compositions that cure to form flexible gels. Unlike the curable resin compositions described above, which cure into hardened masses, the gelable resin compositions cure into flexible, gelled substances that form resilient gelled substances. Gelable resin compositions allow the treated portion of the formation to remain flexible and to resist breakdown.

Generally, the gelable resin compositions useful in accordance with this invention comprise a curable resin, a diluent, and a resin curing agent. When certain resin curing agents, such as polyamides, are used in the curable resin compositions, the compositions form the semi-solid, immovable, gelled substances described above. Where the resin curing agent used may cause the organic resin compositions to form hard, brittle material rather than a desired gelled substance, the curable resin compositions may further comprise one or more "flexibilizer additives" (described in more detail below) to provide flexibility to the cured compositions.

Examples of gelable resins that can be used in the present invention include, but are not limited to, organic resins such as polyepoxide resins (e.g., Bisphenol a-epichlorihydrin resins), polyester resins, urea-aldehyde resins, furan resins, urethane resins, and mixtures thereof. Of these, polyepoxide resins are preferred.

Any solvent that is compatible with the gelable resin and achieves the desired viscosity effect is suitable for use in the present invention. Examples of solvents that may be used in the gelable resin compositions of the present invention include, but are not limited to, phenols; formaldehydes; furfuryl alcohols; furfurals; alcohols; ethers such as butyl glycidyl ether and cresyl glycidyl etherphenyl glycidyl ether; and mixtures thereof. In some embodiments of the present invention, the solvent comprises butyl lactate. Among other things, the solvent acts to provide flexibility to the cured composition. The solvent may be included in the gelable resin composition in an amount sufficient to provide the desired viscosity effect.

Generally, any resin curing agent that may be used to cure an organic resin is suitable for use in the present invention. When the resin curing agent chosen is an amide or a polyamide, generally no flexibilizer additive will be required because, inter alia, such curing agents cause the gelable resin composition to convert into a semi-solid, immovable, gelled substance. Other suitable resin curing agents (such as an amine, a polyamine, methylene dianiline, and other curing agents known in the art) will tend to cure into a hard, brittle material and will thus benefit from the addition of a flexibilizer additive. Generally, the resin curing agent used is included in the gelable resin composition, whether a flexibilizer additive is included or not, in an amount in the range of from about 5% to about 75% by weight of the curable resin. In some embodiments of the present invention, the resin curing agent used is included in the gelable resin composition in an amount in the range of from about 20% to about 75% by weight of the curable resin.

As noted above, flexibilizer additives may be used, inter alia, to provide flexibility to the gelled substances formed from the curable resin compositions. Flexibilizer additives may be used where the resin curing agent chosen would cause the gelable resin composition to cure into a hard and brittle material—rather than a desired gelled substance. For example, flexibilizer additives may be used where the resin curing agent chosen is not an amide or polyamide. Examples of suitable flexibilizer additives include, but are not limited to, an organic ester, an oxygenated organic solvent, an aromatic solvent, and combinations thereof. Of these, ethers, such as dibutyl phthalate, are preferred. Where used, the flexibilizer additive may be included in the gelable resin composition in an amount in the range of from about 5% to about 80% by weight of the gelable resin. In some embodiments of the present invention, the flexibilizer additive may be included in the curable resin composition in an amount in the range of from about 20% to about 45% by weight of the curable resin.

2. Consolidation Fluids—Gelable Compositions—Gelable Aqueous Silicate Compositions In other embodiments, the consolidation fluids of the present invention may comprise a gelable aqueous silicate composition. Generally, the gelable aqueous silicate compositions that are useful in accordance with the present invention generally comprise an aqueous alkali metal silicate solution and a temperature activated catalyst for gelling the aqueous alkali metal silicate solution.

The aqueous alkali metal silicate solution component of the gelable aqueous silicate compositions generally comprise an aqueous liquid and an alkali metal silicate. The aqueous liquid component of the aqueous alkali metal silicate solution generally may be fresh water, salt water (e.g., water containing one or more salts dissolved therein), brine (e.g., saturated salt water), seawater, or any other aqueous liquid that does not adversely react with the other components used in accordance with this invention or with the subterranean formation. Examples of suitable alkali metal silicates include, but are not limited to, one or more of sodium silicate, potassium silicate, lithium silicate, rubidium silicate, or cesium silicate. Of these, sodium silicate is preferred. While sodium silicate exists in many forms, the sodium silicate used in the aqueous alkali metal silicate solution preferably has a $Na_2O$-to-$SiO_2$ weight ratio in the range of from about 1:2 to about 1:4. Most preferably, the sodium silicate used has a $Na_2O$-to-$SiO_2$ weight ratio in the range of about 1:3.2. Generally, the alkali metal silicate is present in the aqueous alkali metal silicate solution component in an amount in the range of from about 0.1% to about 10% by weight of the aqueous alkali metal silicate solution component.

The temperature-activated catalyst component of the gelable aqueous silicate compositions is used, inter alia, to convert the gelable aqueous silicate compositions into the desired semi-solid, immovable, gelled substance described above. Selection of a temperature-activated catalyst is related, at least in part, to the temperature of the subterranean formation to which the gelable aqueous silicate composition will be introduced. The temperature-activated catalysts that can be used in the gelable aqueous silicate compositions of the present invention include, but are not limited to, ammonium sulfate (which is most suitable in the range of from about 60° F. to about 240° F.); sodium acid pyrophosphate (which is most suitable in the range of from about 60° F. to about 240° F.); citric acid (which is most suitable in the range of from about 60° F. to about 120° F.); and ethyl acetate (which is most suitable in the range of from about 60° F. to about 120° F.). Generally, the temperature-activated catalyst is present in the gelable aqueous silicate composition in the range of from about 0.1% to about 5% by weight of the gelable aqueous silicate composition.

3. Consolidation Fluids—Gelable Compositions—Crosslinkable Aqueous Polymer Compositions In other embodiments, the consolidation fluid of the present invention comprises a crosslinkable aqueous polymer compositions. Generally, suitable crosslinkable aqueous polymer compositions comprise an aqueous solvent, a crosslinkable polymer, and a crosslinking agent. Such compositions are similar to those used to form gelled treatment fluids, such as fracturing fluids, but, according to the methods of the present invention, they are not exposed to breakers or de-linkers and so they retain their viscous nature over time.

The aqueous solvent may be any aqueous solvent in which the crosslinkable composition and the crosslinking agent may be dissolved, mixed, suspended, or dispersed therein to facilitate gel formation. For example, the aqueous solvent used may be fresh water, salt water, brine, seawater, or any other aqueous liquid that does not adversely react with the other components used in accordance with this invention or with the subterranean formation.

Examples of crosslinkable polymers that can be used in the crosslinkable aqueous polymer compositions include, but are not limited to, carboxylate-containing polymers and acrylamide-containing polymers. Preferred acrylamide-containing polymers include polyacrylamide, partially hydrolyzed polyacrylamide, copolymers of acrylamide and acrylate, and carboxylate-containing terpolymers and tetrapolymers of acrylate. Additional examples of suitable crosslinkable polymers include hydratable polymers comprising polysaccharides and derivatives thereof and that contain one or more of the monosaccharide units galactose, mannose, glucoside, glucose, xylose, arabinose, fructose, glucuronic acid, or pyranosyl sulfate. Suitable natural hydratable polymers include, but are not limited to, guar gum, locust bean gum, tara, konjak, tamarind, starch, cellulose, karaya, xanthan, tragacanth, and carrageenan, and derivatives of all of the above. Suitable hydratable synthetic polymers and copolymers that may be used in the crosslinkable aqueous polymer compositions include, but are not limited to, polyacrylates, polymethacrylates, polyacrylamides, maleic anhydride, methylvinyl ether polymers, polyvinyl alcohols, and polyvinylpyrrolidone. The crosslinkable polymer used should be included in the crosslinkable aqueous polymer composition in an amount sufficient to form the desired gelled substance in the subterranean formation. In some embodiments of the present invention, the crosslinkable polymer is included in the crosslinkable aqueous polymer composition in an amount in the range of from about 1% to about 30% by weight of the aqueous solvent. In another embodiment of the present invention, the crosslinkable polymer is included in the crosslinkable aqueous polymer composition in an amount in the range of from about 1% to about 20% by weight of the aqueous solvent.

The crosslinkable aqueous polymer compositions of the present invention further comprise a crosslinking agent for crosslinking the crosslinkable polymers to form the desired gelled substance. In some embodiments, the crosslinking agent is a molecule or complex containing a reactive transition metal cation. A most preferred crosslinking agent comprises trivalent chromium cations complexed or bonded to anions, atomic oxygen, or water. Examples of suitable crosslinking agents include, but are not limited to, compounds or complexes containing chromic acetate and/or chromic chloride. Other suitable transition metal cations include chromium VI within a redox system, aluminum III, iron II, iron III, and zirconium IV.

The crosslinking agent should be present in the crosslinkable aqueous polymer compositions of the present invention in an amount sufficient to provide, inter alia, the desired degree of crosslinking. In some embodiments of the present invention, the crosslinking agent is present in the crosslinkable aqueous polymer compositions of the present invention in an amount in the range of from about 0.01% to about 5% by weight of the crosslinkable aqueous polymer composition. The exact type and amount of crosslinking agent or agents used depends upon the specific crosslinkable polymer to be crosslinked, formation temperature conditions, and other factors known to those individuals skilled in the art.

Optionally, the crosslinkable aqueous polymer compositions may further comprise a crosslinking delaying agent, such as a polysaccharide crosslinking delaying agent derived from guar, guar derivatives, or cellulose derivatives. The crosslinking delaying agent may be included in the crosslinkable aqueous polymer compositions, inter alia, to delay crosslinking of the crosslinkable aqueous polymer compositions until desired. One of ordinary skill in the art, with the benefit of this disclosure, will know the appropriate amount of the crosslinking delaying agent to include in the crosslinkable aqueous polymer compositions for a desired application.

4. Consolidation Fluids—Gelable Compositions—Polymerization Organic Monomer Compositions In other embodiments, the gelled liquid compositions of the present invention comprise polymerizable organic monomer compositions. Generally, suitable polymerizable organic monomer compositions comprise an aqueous-base fluid, a water-soluble polymerizable organic monomer, an oxygen scavenger, and a primary initiator.

The aqueous-based fluid component of the polymerizable organic monomer composition generally may be fresh water, salt water, brine, seawater, or any other aqueous liquid that does not adversely react with the other components used in accordance with this invention or with the subterranean formation.

A variety of monomers are suitable for use as the water-soluble polymerizable organic monomers in the present invention. Examples of suitable monomers include, but are not limited to, acrylic acid, methacrylic acid, acrylamide, methacrylamide, 2-methacrylamido-2-methylpropane sulfonic acid, 2-dimethylacrylamide, vinyl sulfonic acid, N,N-dimethylaminoethylmethacrylate, 2-triethylammoniumethylmethacrylate chloride, N,N-dimethylaminopropylmethacryl-amide, methacrylamidepropyltriethylammonium chloride, N-vinyl pyrrolidone, vinyl-phosphonic acid, and methacryloyloxyethyl trimethylammonium sulfate, and mixtures thereof. Preferably, the water-soluble polymerizable organic monomer should be self-crosslinking. Examples of suitable monomers which are self crosslinking include, but are not limited to, hydroxyethylacrylate, hydroxymethylacrylate, hydroxyethylmethacrylate, N-hydroxymethylacrylamide, N-hydroxymethyl-methacrylamide, polyethylene glycol acrylate, polyethylene glycol methacrylate, polypropylene gylcol acrylate, polypropylene glycol methacrylate, and mixtures thereof. Of these, hydroxyethylacrylate is preferred. An example of a particularly preferable monomer is hydroxyethylcellulose-vinyl phosphoric acid.

The water-soluble polymerizable organic monomer (or monomers where a mixture thereof is used) should be included in the polymerizable organic monomer composition in an amount sufficient to form the desired gelled substance after placement of the polymerizable organic monomer composition into the subterranean formation. In some embodiments of the present invention, the water-soluble polymerizable organic monomer is included in the polymerizable organic monomer composition in an amount in the range of from about 1% to about 30% by weight of the aqueous-base fluid. In another embodiment of the present invention, the water-soluble polymerizable organic monomer is included in the polymerizable organic monomer composition in an amount in the range of from about 1% to about 20% by weight of the aqueous-base fluid.

The presence of oxygen in the polymerizable organic monomer composition may inhibit the polymerization process of the water-soluble polymerizable organic monomer or monomers. Therefore, an oxygen scavenger, such as stannous chloride, may be included in the polymerizable monomer composition. In order to improve the solubility of stannous chloride so that it may be readily combined with the polymerizable organic monomer composition on the fly, the stannous chloride may be pre-dissolved in a hydrochloric acid solution. For example, the stannous chloride may be dissolved in a 0.1% by weight aqueous hydrochloric acid solution in an amount of about 10% by weight of the resulting solution. The resulting stannous chloride-hydrochloric acid solution may be included in the polymerizable organic monomer composition in an amount in the range of from about 0.1% to about 10% by weight of the polymerizable organic monomer composition. Generally, the stannous chloride may be included in the polymerizable organic monomer composition of the present invention in an amount in the range of from about 0.005% to about 0.1% by weight of the polymerizable organic monomer composition.

The primary initiator is used, inter alia, to initiate polymerization of the water-soluble polymerizable organic monomer(s) used in the present invention. Any compound or compounds that form free radicals in aqueous solution may be used as the primary initiator. The free radicals act, inter alia, to initiate polymerization of the water-soluble polymerizable organic monomer present in the polymerizable organic monomer composition. Compounds suitable for use as the primary initiator include, but are not limited to, alkali metal persulfates; peroxides; oxidation-reduction systems employing reducing agents, such as sulfites in combination with oxidizers; and azo polymerization initiators. Preferred azo polymerization initiators include 2,2'-azobis(2-imidazole-2-hydroxyethyl) propane, 2,2'-azobis(2-aminopropane), 4,4'-azobis(4-cyanovaleric acid), and 2,2'-azobis(2-methyl-N-(2-hydroxyethyl) propionamide. Generally, the primary initiator should be present in the polymerizable organic monomer composition in an amount sufficient to initiate polymerization of the water-soluble polymerizable organic monomer(s). In certain embodiments of the present invention, the primary initiator is present in the polymerizable organic monomer composition in an amount in the range of from about 0.1% to about 5% by weight of the water-soluble polymerizable organic monomer(s). One skilled in the art will recognize that as the polymerization temperature increases, the required level of activator decreases.

Optionally, the polymerizable organic monomer compositions further may comprise a secondary initiator. A secondary initiator may be used, for example, where the immature aqueous gel is placed into a subterranean formation that is relatively cool as compared to the surface mixing, such as when placed below the mud line in offshore operations. The secondary initiator may be any suitable water-soluble compound or compounds that may react with the primary initiator to provide free radicals at a lower temperature. An example of a suitable secondary initiator is triethanolamine. In some embodiments of the present invention, the secondary initiator is present in the polymerizable organic monomer composition in an amount in the range of from about 0.1% to about 5% by weight of the water-soluble polymerizable organic monomer(s).

Also optionally, the polymerizable organic monomer compositions of the present invention further may comprise a crosslinking agent for crosslinking the polymerizable organic monomer compositions in the desired gelled substance. In some embodiments, the crosslinking agent is a molecule or complex containing a reactive transition metal cation. A most preferred crosslinking agent comprises trivalent chromium cations complexed or bonded to anions, atomic oxygen, or water. Examples of suitable crosslinking agents include, but are not limited to, compounds or complexes containing chromic acetate and/or chromic chloride. Other suitable transition metal cations include chromium VI within a redox system, aluminum III, iron II, iron III, and zirconium IV. Generally, the crosslinking agent may be present in polymerizable organic monomer compositions in an amount in the range of from 0.01% to about 5% by weight of the polymerizable organic monomer composition.

Therefore, the present invention is well adapted to carry out the objects and attain the ends and advantages mentioned as well as those that are inherent therein. While numerous changes may be made by those skilled in the art, such changes are encompassed within the spirit of this invention as defined by the appended claims.

What is claimed is:

1. A method of treating a subterranean formation penetrated by a well bore comprising:

injecting a consolidation fluid thereby effecting a more uniform penetration of the consolidation fluid into the subterranean formation into the subterranean formation while periodically applying a pressure pulse having a given amplitude and frequency to the consolidation fluid.

2. The method of claim 1 wherein the step of applying the pressure pulse is performed at about, or above, the earth's surface.

3. The method of claim 1 wherein the step of injecting the consolidation fluid into the subterranean formation maintains a positive pressure in the subterranean formation.

4. The method of claim 1 wherein the amplitude of the pressure pulse is in the range of from about 10 psi to about 3,000 psi.

5. The method of claim 4 wherein the amplitude of the pressure pulse is below the fracture pressure of the formation.

6. The method of claim 1 further comprising the step of generating a pressure pulse having an amplitude different from the amplitude of a previous pressure pulse.

7. The method of claim 1 wherein the amplitude of the pressure pulse is less than that sufficient to fracture the subterranean formation.

8. The method of claim 1 wherein the frequency is in the range of about 0.001 Hz to about 1 Hz.

9. The method of claim 1 wherein the consolidation fluid comprises a tackifying agent and a solvent.

10. The method of claim 9 wherein the tackifying agent is selected from the group consisting of polyamides, condensation reaction products of a polyacid and a polyamine, polyesters, polycarbonates, polycarbamates, natural resins, and combinations thereof.

11. The method of claim 9 wherein the solvent is selected from the group consisting of butylglycidyl ether, dipropylene glycol methyl ether, butyl bottom alcohol, dipropylene glycol dimethyl ether, diethyleneglycol methyl ether, ethyleneglycol butyl ether, methanol, butyl alcohol, isopropyl alcohol, diethyleneglycol butyl ether, propylene carbonate, d-limonene, 2-butoxy ethanol, butyl acetate, furfuryl acetate, butyl lactate, dimethyl sulfoxide, dimethyl formamide, fatty acid methyl esters, and combinations thereof.

12. The method of claim 9 wherein the consolidation fluid further comprises a multifunctional material.

13. The method of claim 12 wherein the multifunctional material is selected from the group consisting of aldehydes, dialdehydes, hemiacetals, aldehyde releasing compounds, diacid halides, dihalides, polyacid anhydrides, epoxides, furfuraldehydes, glutaraldehydes, aldehyde condensates, and combinations thereof.

14. The method of claim 1 wherein the consolidation fluid comprises a resin and a solvent.

15. The method of claim 14 wherein the resin is selected from the group consisting of two component epoxy based resins, novolak resins, polyepoxide resins, phenol-aldehyde resins, urea-aldehyde resins, urethane resins, phenolic resins, furan resins, furanlfurfuryl alcohol resins, phenolic/latex resins, phenol formaldehyde resins, polyester resins, hybrids of polyester resins, copolymers of polyester resins, polyurethane resins, hybrids of polyurethane resins, copolymers of polyurethane resins, acrylate resins, and combinations thereof.

16. The method of claim 14 wherein the solvent is selected from the group consisting of butylglycidyl ether, dipropylene glycol methyl ether, butyl bottom alcohol, dipropylene glycol dimethyl ether, diethyleneglycol methyl ether, ethyleneglycol butyl ether, methanol, butyl alcohol, isopropyl alcohol, diethyleneglycol butyl ether, propylene carbonate, d-limonene, 2-butoxy ethanol, butyl acetate, furfuryl acetate, butyl lactate, dimethyl sulfoxide, dimethyl formamide, fatty acid methyl esters, and combinations thereof.

17. A method of controlling the migration of unconsolidated particulates in a portion of a subterranean formation penetrated by a well bore comprising:

injecting a consolidation fluid into the well bore and into the subterranean formation while periodically applying a pressure pulse having a given amplitude and frequency to the consolidation fluid thereby effecting a more uniform penetration of the consolidation fluid into the subterranean formation; and, allowing the consolidation fluid to control the migration of unconsolidated particulates.

18. The method of claim 17 wherein the step of applying the pressure pulse is performed at about, or above, the earth's surface.

19. The method of claim 17 wherein the step of injecting the consolidation fluid into the subterranean formation maintains a positive pressure in the subterranean formation.

20. The method of claim 17 wherein the amplitude of the pressure pulse is in the range of from about 10 psi to about 3,000 psi.

21. The method of claim 20 wherein the amplitude of the pressure pulse is below the fracture pressure of the formation.

22. The method of claim 17 further comprising the step of generating a pressure pulse having an amplitude different from the amplitude of a previous pressure pulse.

23. The method of claim 17 wherein the amplitude of the pressure pulse is less than that sufficient to fracture the subterranean formation.

24. The method of claim 17 wherein the frequency is in the range of about 0.001 Hz to about 1 Hz.

25. The method of claim 17 wherein the consolidation fluid comprises a tackifying agent and a solvent.

26. The method of claim 25 wherein the tackifying agent is selected from the group consisting of polyamides, condensation reaction products of polyacids and polyamines, polyesters, polycarbonates, polycarbamates, natural resins, and combinations thereof.

27. The method of claim 25 wherein the solvent is selected from the group consisting of butylglycidyl ether, dipropylene glycol methyl ether, butyl bottom alcohol, dipropylene glycol dimethyl ether, diethyleneglycol methyl ether, ethyleneglycol butyl ether, methanol, butyl alcohol, isopropyl alcohol, diethyleneglycol butyl ether, propylene carbonate, d-limonene, 2-butoxy ethanol, butyl acetate, furfuryl acetate, butyl lactate, dimethyl sulfoxide, dimethyl formamide, fatty acid methyl esters, and combinations thereof.

28. The method of claim 25 wherein the consolidation fluid further comprises a multifunctional material.

29. The method of claim 28 wherein the multifunctional material is selected from the group consisting of aldehydes, dialdehydes, hemiacetals, aldehyde releasing compounds, diacid halides, dihalids, polyacid anhydrides, epoxides, furfuraldehydes, glutaraldehyde, aldehyde condensates, and combinations thereof.

30. The method of claim 17 wherein the consolidation fluid comprises a resin and a solvent.

31. The method of claim 30 wherein the resin is selected from the group consisting of two component epoxy based resins, novolak resins, polyepoxide resins, phenol-aldehyde resins, urea-aldehyde resins, urethane resins, phenolic resins, furan resins, furan/furfuryl alcohol resins, phenolic/latex resins, phenol formaldehyde resins, polyester resins, hybrids of polyester resins, copolymers of polyester resins, polyurethane resins, hybrids of polyurethane resins, copolymers of polyurethane resins, acrylate resins, and combinations thereof.

32. The method of claim 30 wherein the solvent is selected from the group consisting of butylglycidyl ether, dipropylene glycol methyl ether, butyl bottom alcohol, dipropylene glycol dimethyl ether, diethyleneglycol methyl ether, ethyleneglycol butyl ether, methanol, butyl alcohol, isopropyl alcohol, diethyleneglycol butyl ether, propylene carbonate, d-limonene, 2-butoxy ethanol, butyl acetate, furfuryl acetate, butyl lactate, dimethyl sulfoxide, dimethyl formamide, fatty acid methyl esters, and combinations thereof.

33. A method of using a pressure pulse to enhance the effectiveness of placement of a consolidation fluid in a portion of a subterranean formation penetrated by a well bore, comprising injecting a consolidation fluid into the well bore and into the subterranean formation while periodically applying a pressure pulse having a given amplitude and frequency to the consolidation fluid so as to more uniformly place the consolidation fluid in the portion of the subterranean formation.

34. The method of claim 33 wherein the step of applying the pressure pulse is performed at about, or above, the earth's surface.

35. The method of claim 33 wherein the step of injecting the consolidation fluid into the subterranean formation maintains a positive pressure in the subterranean formation.

36. The method of claim 33 wherein the amplitude of the pressure pulse is in the range of from about 10 psi to about 3,000 psi.

37. The method of claim 36 wherein the amplitude of the pressure pulse is below the fracture pressure of the formation.

38. The method of claim 33 further comprising the step of generating a pressure pulse having an amplitude different from the amplitude of a previous pressure pulse.

39. The method of claim 33 wherein the amplitude of the pressure pulse is less than that sufficient to fracture the subterranean formation.

40. The method of claim 33 wherein the frequency is in the range of about 0.001 Hzto about 1 Hz.

41. The method of claim 33 wherein the consolidation fluid comprises a tackifying agent and a solvent.

42. The method of claim 41 wherein the tackifying agent is selected from the group consisting of polyamides, condensation reaction products of polyacids and polyamines, polyesters, polycarbonates, polycarbamates, natural resins, and combinations thereof.

43. The method of claim 41 wherein the solvent is selected from the group consisting of butylglycidyl ether, dipropylene glycol methyl ether, butyl bottom alcohol, dipropylene glycol dimethyl ether, diethyleneglycol methyl ether, ethyleneglycol butyl ether, methanol, butyl alcohol, isopropyl alcohol, diethyleneglycol butyl ether, propylene carbonate, d-limonene, 2-butoxy ethanol, butyl acetate, furfuryl acetate, butyl lactate, dimethyl sulfoxide, dimethyl formamide, fatty acid methyl esters, and combinations thereof.

44. The method of claim 41 wherein the consolidation fluid further comprises a multifunctional material.

45. The method of claim 44 wherein the multifunctional material is selected from the group consisting of aldehydes, dialdehydes, hemiacetals, aldehyde releasing compounds, diacid halides, dihalides, polyacid anhydrides, epoxides, furfuraldehydes, glutaraldehydes, aldehyde condensates, and combinations thereof.

46. The method of claim 33 wherein the consolidation fluid comprises a resin and a solvent.

47. The method of claim 46 wherein the resin is selected from the group consisting of two component epoxy based resins, novolak resins, polyepoxide resins, phenol-aldehyde resins, urea-aldehyde resins, urethane resins, phenolic resins, furan resins, furan/furfuryl alcohol resins, phenolic/latex resins, phenol formaldehyde resins, polyester resins, hybrids of polyester resins, copolymers of polyester resins, polyurethane resins, hybrids of polyurethane resins, copolymers of polyurethane resins, acrylate resins, and combinations thereof.

48. The method of claim 46 wherein the solvent is selected from the group consisting of butylglycidyl ether, dipropylene glycol methyl ether, butyl bottom alcohol, dipropylene glycol dimethyl ether, diethyleneglycol methyl ether, ethyleneglycol butyl ether, methanol, butyl alcohol, isopropyl alcohol, diethyleneglycol butyl ether, propylene carbonate, d-limonene, 2-butoxy ethanol, butyl acetate, furfuryl acetate, butyl lactate, dimethyl sulfoxide, dimethyl formamide, fatty acid methyl esters, and combinations thereof.

* * * * *

UNITED STATES PATENT AND TRADEMARK OFFICE

CERTIFICATE OF CORRECTION

PATENT NO. : 7,114,560 B2
APPLICATION NO. : 10/863706
DATED : October 3, 2006
INVENTOR(S) : Philip D. Nguyen and Ronald D. Dusterhoft It is certified that error appears in the above-identified patent and that said Letters Patent is hereby corrected as shown below:

Column 19 Claim 1

Lines 40 to 42, after "consolidation fluid", delete "thereby effecting a more uniform penetration of the consolidation fluid into the subterranean formation" and insert --into the well bore and--.

Line 45, after "fluid", insert --, thereby effecting a more uniform penetration of the consolidation fluid into the subterranean formation--.

Signed and Sealed this

First Day of May, 2007

JON W. DUDAS
*Director of the United States Patent and Trademark Office*